US009785070B2

(12) United States Patent
Sugahara et al.

(10) Patent No.: US 9,785,070 B2
(45) Date of Patent: Oct. 10, 2017

(54) MAGNETIC CARRIER, TWO-COMPONENT DEVELOPER, REPLENISHMENT DEVELOPER, AND IMAGE FORMATION METHOD

(71) Applicant: CANON KABUSHIKI KAISHA, Tokyo (JP)

(72) Inventors: Nobuyoshi Sugahara, Tokyo (JP); Hironori Minagawa, Moriya (JP); Wakashi Iida, Toride (JP); Atsushi Nakano, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/241,317

(22) Filed: Aug. 19, 2016

(65) Prior Publication Data

US 2017/0060010 A1 Mar. 2, 2017

(30) Foreign Application Priority Data

Aug. 25, 2015 (JP) ..... 2015-165810

(51) Int. Cl.
*G03G 9/083* (2006.01)
*G03G 15/09* (2006.01)

(52) U.S. Cl.
CPC ..... *G03G 9/0831* (2013.01); *G03G 15/09* (2013.01)

(58) Field of Classification Search
CPC ..... G03G 9/0831
See application file for complete search history.

(56) References Cited

U.S. PATENT DOCUMENTS 5,288,578 A 2/1994 Sugizaki et al.
5,437,949 A 8/1995 Kanbayashi et al.
5,607,806 A 3/1997 Kanbayashi et al.
5,635,326 A 6/1997 Kanbayashi et al.
5,670,288 A 9/1997 Okado et al.
5,700,617 A 12/1997 Takiguchi et al.
5,747,209 A 5/1998 Takiguchi et al.
5,851,714 A 12/1998 Taya et al.
5,912,099 A 6/1999 Kanbayashi et al.
5,922,500 A 7/1999 Iida et al.
5,994,018 A 11/1999 Iida et al.
6,013,402 A 1/2000 Kanbayashi et al.
6,022,659 A 2/2000 Kanbayashi et al.
6,077,635 A 6/2000 Okado et al.
6,124,067 A 9/2000 Mikuriya et al.
6,326,114 B1 12/2001 Itakura et al.
6,372,400 B1 4/2002 Yoshizaki et al.
6,506,531 B1 1/2003 Hakata et al.
6,528,222 B2 3/2003 Kohtaki et al.
6,586,147 B2 7/2003 Iida et al.
6,664,016 B2 12/2003 Kanbayashi et al.
6,751,424 B2 6/2004 Komatsu et al.
6,808,852 B2 10/2004 Hotta et al.
6,929,894 B2 8/2005 Sugahara et al.
7,115,349 B2 10/2006 Iida et al.
7,138,213 B2 11/2006 Itakura et al.
7,144,668 B2 12/2006 Baba et al.
7,147,980 B2 12/2006 Itakura et al.
7,272,348 B2 * 9/2007 Okamoto ..... G03G 15/0921 399/269
7,279,262 B2 10/2007 Fujikawa et al.
7,288,348 B2 10/2007 Hayami et al.
7,297,455 B2 11/2007 Fujikawa et al.
7,300,733 B2 11/2007 Sugahara et al.
7,396,626 B2 7/2008 Fujikawa et al.
7,396,629 B2 * 7/2008 Baba ..... G03G 15/09 430/120.1
7,442,478 B2 10/2008 Itakura et al.
7,455,947 B2 11/2008 Ida et al.
7,536,132 B2 5/2009 Minagawa
7,816,063 B2 10/2010 Hashimoto et al.
9,075,328 B2 7/2015 Minagawa et al.
9,158,217 B2 10/2015 Takahashi et al.
9,372,420 B2 6/2016 Mizo et al.
2014/0096409 A1 4/2014 Ohtsu et al.
2014/0101966 A1 4/2014 Minagawa et al.
2014/0137428 A1 5/2014 Takenaka et al.
2015/0017581 A1 1/2015 Tsuchida et al.
2015/0241807 A1 8/2015 Sugahara et al.
2015/0268577 A1 9/2015 Takahashi et al.
2015/0309432 A1 10/2015 Tsujimoto et al.
2016/0062257 A1 3/2016 Sugahara et al.

FOREIGN PATENT DOCUMENTS

JP H05-072815 3/1993
JP 2000-039740 2/2000
JP 2000-314990 11/2000
JP 2001-075315 3/2001
JP 2001-343790 12/2001
JP 2002-091090 3/2002
JP 2008-181162 8/2008
JP 2009-139707 6/2009

OTHER PUBLICATIONS

U.S. Appl. No. 15/196,443, Nobuyoshi Sugahara, filed Jun. 29, 2016.
U.S. Appl. No. 15/248,375, Yuto Onozaki, filed Aug. 26, 2016.

* cited by examiner

*Primary Examiner* — Hoa V Le
(74) *Attorney, Agent, or Firm* — Fitzpatrick Cella Harper and Scinto

(57) ABSTRACT

A magnetic carrier comprising: a magnetic material-dispersed resin carrier core material; and a resin coating layer on the surface of the magnetic material-dispersed resin carrier core material, wherein the magnetic material-dispersed resin carrier core material contains a core material particle containing a magnetic material and a binder resin, and a primer compound having an amino group, the resin coating layer contains a coating resin A, which is a polymer of monomers including at least a (meth)acrylic acid ester having an alicyclic hydrocarbon group, and the content of the primer compound in the magnetic material-dispersed resin carrier core material and the content of the resin coating layer are in specific range.

15 Claims, 6 Drawing Sheets

Fig. 5A
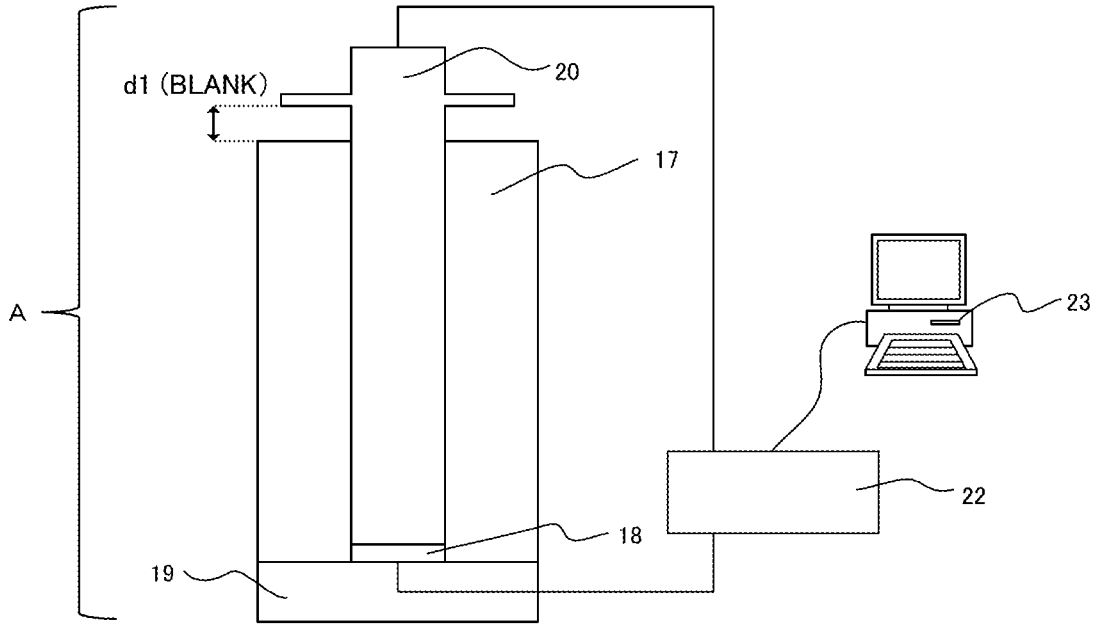
Fig. 5B
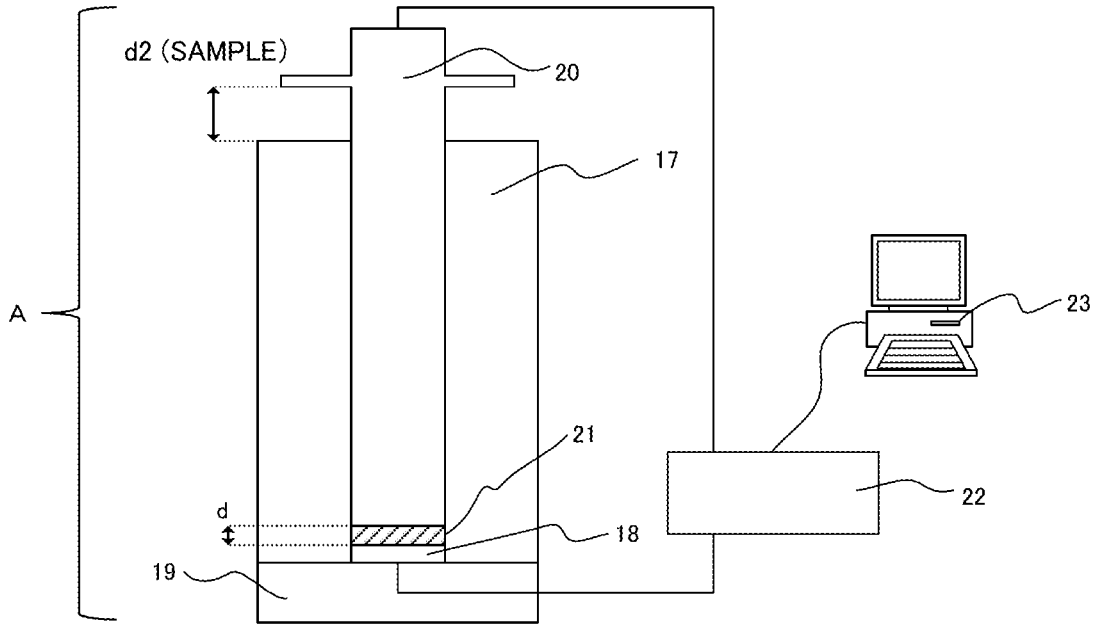
Fig. 5

MAGNETIC CARRIER, TWO-COMPONENT DEVELOPER, REPLENISHMENT DEVELOPER, AND IMAGE FORMATION METHOD

BACKGROUND OF THE INVENTION

Field of the Invention

The present invention relates to a magnetic carrier that is used in a two-component developer for developing (visualizing) an electrostatic latent image (electrostatically charged image) in accordance with an electrophotographic method, and relates to a two-component developer that has the magnetic carrier.

Description of the Related Art

Electrophotographic methods, which in recent years have come to be widely used in copiers, printers and the like, are required to cope with various targets such as fine lines, small characters, photographs and color documents. Higher image quality, higher definition, higher speed, and continuous output are further concurrent demands, and these demands will arguably become yet more exacting in the future.

As carrier particles that satisfy these demands, lightweight composite particles that have a specific gravity in the range of about 2.0 to 5.0 and that do not result in toner breakage even at high speeds or continuous output are widely used at present.

Demands for enhancing the characteristics of carrier particles are increasing, and in order to achieve higher image quality, particularly in full color images, toner of small particle size is required to be excellent in chargeability, as a magnetic carrier.

Specifically, it is important that the toner be imparted with a uniform charge amount, that the charge amount should not vary even after use over long periods of time, and that the charge amount should not vary with changes in the environment. Exhibiting excellent durability is a pressing demand in magnetic carriers that satisfy these characteristics.

Japanese Patent Application Publication No. 2008-181162, Japanese Patent Application Publication No. 2000-314990, Japanese Patent Application Publication No. 2000-039740, Japanese Patent Application Publication No. H5-072815 and Japanese Patent Application Publication No. 2002-091090 disclose magnetic carriers in which (1) the particle surface of magnetic core material particles is treated with an aminosilane coupling agent, and is further coated with a resin, in order to enhance durability of the magnetic carriers.

SUMMARY OF THE INVENTION

However, yet further improvements are desirable in magnetic carriers of excellent durability which are the most demanded at present.

Magnetic carrier core particles are ordinarily made up of a magnetic material component and a resin component in order to form lightweight composite particles. The influence of the environment on charging is one concern in the use of resin components that are inexpensive and easy to produce.

In this regard, Japanese Patent Application Publication No. 2009-139707, Japanese Patent Application Publication No. 2001-075315 and Japanese Patent Application Publication No. 2001-343790 disclose inventions that involve restricting the amount of moisture adsorption in magnetic carrier particles. The amount of moisture adsorption of the magnetic carrier particles could be curtailed as a result, but further improvements are required.

It is an object of the present invention to provide a lightweight and high-durability magnetic carrier that does not result in image spattering and is not prone to giving rise to differences in image density in various environments including high-temperature and high-humidity environments, normal-temperature and low-humidity environments and normal-temperature and normal-humidity environments.

It is a further object of the present invention to provide a magnetic carrier thanks to which image density exhibits little change before and after standing in a high-temperature and high-humidity environment.

It is yet another object of the present invention to provide a two-component developer having the above magnetic carrier.

The present invention is a magnetic carrier comprising a magnetic material-dispersed resin carrier core material and a resin coating layer on the surface of the magnetic material-dispersed resin carrier core material, wherein the magnetic material-dispersed resin carrier core material contains a core material particle containing a magnetic material and a binder resin, and a primer compound having an amino group, the resin coating layer has a coating resin A, which is a polymer of monomers including at least a (meth)acrylic acid ester having an alicyclic hydrocarbon group, the content of the primer compound is from 0.10 parts by mass to 0.90 parts by mass with respect to 100 parts by mass of the core material particle, and the content of the resin coating layer is from 0.5 parts by mass to 5.0 parts by mass with respect to 100 parts by mass of the magnetic material-dispersed resin carrier core material.

The present invention is also a two-component developer and a replenishment developer having the magnetic carrier and a toner. The invention relates also to an image formation method in which the above magnetic carrier is utilized.

The present invention succeeds in providing a magnetic carrier having lightweight and high-durability magnetic carrier particles, and not prone to giving rise to differences in image density in various environments including high-temperature and high-humidity environments, normal-temperature and low-humidity environments and normal-temperature and normal-humidity environments.

The present invention further succeeds in providing a magnetic carrier thanks to which image density exhibits little change before and after standing in a high-temperature and high-humidity environment.

Further, the present invention allows providing a two-component developer having the above magnetic carrier.

Further features of the present invention will become apparent from the following description of exemplary embodiments (with reference to the attached drawings).

BRIEF DESCRIPTION OF THE DRAWINGS

FIG. 5 is a schematic diagram of a resistivity measuring device of a magnetic carrier.

DESCRIPTION OF THE EMBODIMENTS

Figure 1:
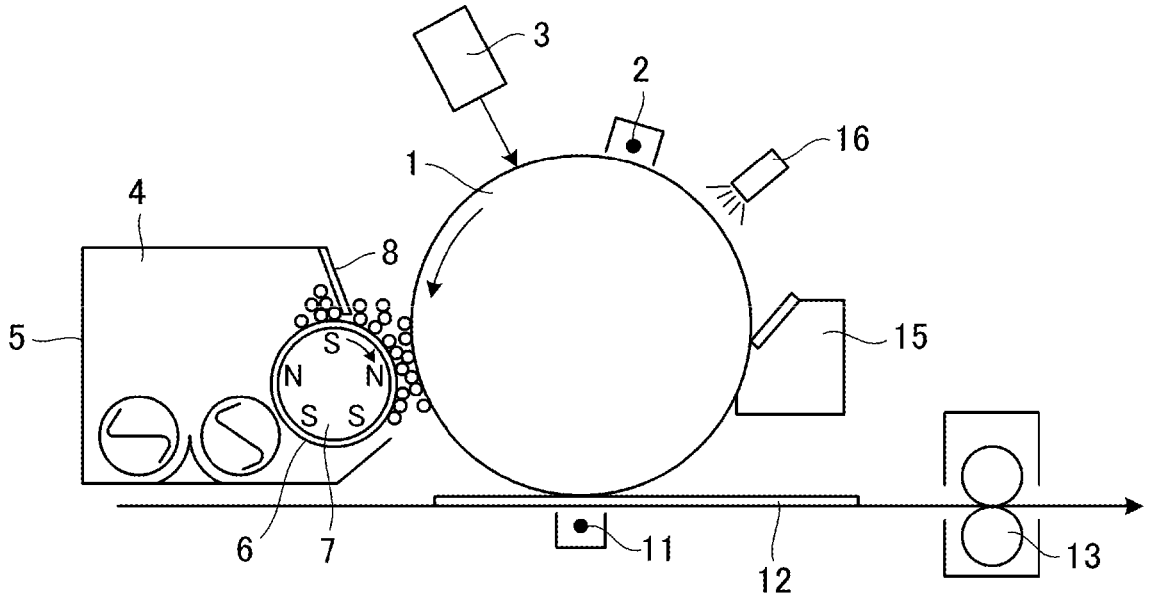
FIG. 1 is a schematic diagram of an image forming apparatus that can be used in the present invention.

The magnetic carrier of the present invention is a magnetic carrier comprising a magnetic material-dispersed resin carrier core material and a resin coating layer on the surface of the magnetic material-dispersed resin carrier core material. The magnetic material-dispersed resin carrier core material contains core material particles each containing a magnetic material and a binder resin, and a primer compound having an amino group. The resin coating layer has a coating resin A, which is a polymer of monomers including at least a (meth)acrylic acid ester having an alicyclic hydrocarbon group. The content of the primer compound in the magnetic material-dispersed resin carrier core material is 0.10 parts by mass to 0.90 parts by mass with respect to 100 parts by mass of the core material particles. The content of the resin coating layer is 0.5 parts by mass to 5.0 parts by mass with respect to 100 parts by mass of the magnetic material-dispersed resin carrier core material.

Although the function of the primer compound is to increase adhesion between the magnetic material-dispersed resin carrier core material and the resin coating layer, it is also known that primer compounds having an amino group elicit the effect of enhancing chargeability of magnetic carriers. Accordingly, there are instances where chargeability is adjusted by adding a primer compound in particular to coat resins in the form of fluorine-containing acrylic resins or silicone resins, which have low chargeability. However, although chargeability in a normal-temperature and low-humidity environment is enhanced, no enhanced chargeability is observed in high-temperature and high-humidity environments. This gives rise to the problem of widening of the so-called environment difference. In the case of fluorine-containing acrylic resins or silicone resins the envisaged chargeability-enhancing effect fails to be achieved even when using a primer compound in the form of a primer layer between the magnetic material-dispersed resin carrier core material and the resin coating layer.

The function of the resin coating layer is to impart stable long-term charge to toner. The most important considerations in terms of achieving that goal is that the coating film strength of the coat resin should be high, and that the coat resin surface should undergo no alteration due to stress from friction or the like. Fluorine-containing acrylic resins and silicone resins have been used in the conventional art in order to achieve the above effect. When a copier is used continually under harsh usage conditions, for instance with environment fluctuations and continuous output, the coat resin may exhibit for instance chipping or peeling, which interferes with the image. That is because fluorine-containing acrylic resins and silicone resins are characteristically hard and brittle.

Such being the case, acrylic resins and polyester resins are used in some instances as the coat resin. Acrylic resins and polyester resins are characteristically neither hard nor brittle, and are not prone to chipping or peeling, as compared with fluorine-containing acrylic resins and silicone resins, while magnetic carrier core materials are readily coated by acrylic resins and polyester resins.

Weight reduction is required in order to impart stable charge to toner over a long period of time. Accordingly, magnetic carrier core materials that are used in magnetic carrier particles have come in recent years to be made up of a resin and a magnetic material. Magnetic ferrite particles, which have been widely used conventionally as magnetic carrier particles, are heavy particles having a specific gravity of 4.7 or higher, but can be produced inexpensively. Accordingly, resins that are used in magnetic carrier core materials made up of a resin and a magnetic material are required to be inexpensive as well.

Examples of such resins include for instance phenolic resins. Phenolic resins are superior resins not only in terms of being inexpensive and easy to handle, but also in terms of affording high particle strength when a thermosetting phenolic resin is made into particles.

Phenolic resins have however high moisture adsorption and are prone to giving rise to fluctuations in density and color in output images due to environment variations.

Moisture adsorption is improved somewhat when using, by contrast, a fluorine-containing acrylic resin or a silicone resin as the coat resin, but moisture adsorption and environment differences in chargeability have failed to be improved in acrylic or polyester resins.

In the light of these results, the inventors conducted extensive studies on a carrier design that should allow achieving all the effects of long-term stabilization of a developer elicited by low-specific gravity core material particles, adhesion and chargeability enhancement elicited by a primer compound having an amino group, and image stability elicited by an acrylic coat resin, and arrived at the present invention on the basis of these studies.

In the magnetic carrier of the present invention, the magnetic material-dispersed resin carrier core material comprises core material particles each containing a magnetic material and a binder resin, and a primer compound having an amino group. Preferably, the core material particle has a primer layer having the primer compound, on a surface layer of the core material particles. In the magnetic carrier of the present invention, a resin coating layer, including a coating resin A that is a polymer of monomers including a (meth) acrylic acid ester having an alicyclic hydrocarbon group, is formed on the surface of the magnetic material-dispersed resin carrier core material.

As a result, the magnetic carrier of the present invention allows enhancing chargeability in high-temperature and high-humidity environments, without improving chargeability more than necessary in normal-temperature and low-humidity environments. It is deemed that the positive chargeability of the magnetic carrier is enhanced in that some of the amino groups of the primer compound become ammonium ions, on account of moisture, in a high-humidity environment. In a low humidity environment, by contrast, the amino groups do not turn readily into ammonium ions, and chargeability is not enhanced more than necessary. The characteristics of the coating resin are an important factor in terms of eliciting this effect.

As a result of extensive research, the inventors have found that the coating resin that brings out the above effect maximally is a polymer of monomers including a (meth) acrylic acid ester having an alicyclic hydrocarbon group. Although the details involved remain unclear, the inventors speculate the following. Specifically, (meth)acrylic acid esters having alicyclic hydrocarbon groups have lower polarity and higher water-repellency than ordinary (meth) acrylic acid esters. Therefore, when a magnetic material-dispersed resin carrier core material having a primer compound is coated with the coating resin of the present invention, the part of the (meth)acrylic acid ester having a low-polarity alicyclic hydrocarbon group aligns readily with the magnetic carrier surface layer.

It is deemed that, as a result, the traffic of moisture across the carrier surface layer portion decreases, and moisture having been taken up inward of the alicyclic hydrocarbon groups of the carrier surface layer is not released readily out of the carrier; hence, positive chargeability is enhanced in a high-humidity environment by virtue of the effect of the amino group of the primer compound. It is found that, meanwhile, the alicyclic hydrocarbon group on the carrier surface layer reduces traffic of moisture to the atmosphere, and accordingly allows reducing charge relaxation by humidity and reducing changes in image density before and after standing.

The effect of the present invention failed to be obtained, in actual verification, in the case of a fluorine-containing acrylic resin or a silicone resin, since those resins do not let moisture through, or in the case of a polyester resin or an acrylic resin having no alicyclic hydrocarbon group, since traffic of moisture is excessive in those resins.

The coating resin used in the present invention is a polymer (coating resin A) of monomers that include at least a (meth)acrylic acid ester having an alicyclic hydrocarbon group. The (meth)acrylic acid ester-based resin having an alicyclic hydrocarbon group has the functions of smoothing the coating film surface of the resin with which the surface of a magnetic carrier core is coated, of suppressing adhesion of toner-derived components, and of curtailing drops in chargeability. In the present invention, the coating resin has also the effect of lowering the adhesion-desorption frequency of moisture, and characteristically allows enhancing the charge imparting effect of the primer compound in high-humidity environments. Further, chargeability relaxation by standing can be reduced, and image density difference before and after standing can be likewise reduced.

In a case where there is no (meth)acrylic acid ester monomer having an alicyclic hydrocarbon group, the resin coating layer of the magnetic carrier degrades, image density varies and image quality decreases in long-term use.

Examples of predetermined (meth)acrylic acid ester monomers having an alicyclic hydrocarbon group as used in the present invention include for instance cyclobutyl acrylate, cyclopentyl acrylate, cyclohexyl acrylate, cycloheptyl acrylate, dicyclopentenyl acrylate, dicyclopentanyl acrylate, cyclobutyl methacrylate, cyclopentyl methacrylate, cyclohexyl methacrylate, cycloheptyl methacrylate, dicyclopentenyl methacrylate and dicyclopentanyl methacrylate. One type or two or more types of the foregoing monomers may be selected and used.

The coating resin A may be a copolymer in which another (meth)acrylic monomer can be used as a monomer, besides the (meth)acrylic acid ester having an alicyclic hydrocarbon group.

Examples of the other (meth)acrylic monomer include for instance methyl acrylate, methyl methacrylate, ethyl acrylate, ethyl methacrylate, butyl (n-butyl, sec-butyl, iso-butyl or tert-butyl; likewise hereafter) acrylate, butyl methacrylate, 2-ethylhexyl acrylate, 2-ethylhexyl methacrylate, acrylic acid and methacrylic acid.

Preferably, the content of the (meth)acrylic acid ester monomer having an alicyclic hydrocarbon group is 50.0 parts by mass to 95.0 parts by mass (more preferably, 50.0 parts by mass to 90.0 parts by mass) with respect to 100 parts by mass of the total monomers of the coating resin A, in terms of readily achieving a synergistic effect with the primer compound of the present invention.

The weight-average molecular weight (Mw) of the coating resin (coating resin A) used in the present invention is preferably 20,000 to 120,000, more preferably 30,000 to 100,000, from the viewpoint of stability of coating.

The amount of primer compound having an amino group and used in the present invention is 0.10 parts by mass to 0.90 parts by mass, preferably 0.10 parts by mass to 0.80 parts by mass, and yet more preferably 0.10 parts by mass to 0.60 parts by mass, or 0.20 parts by mass to 0.80 parts by mass, with respect to 100 parts by mass of the core material particles of the magnetic carrier.

Chargeability becomes difficult to control if the amount of primer compound is excessively large or excessively small. The amount of the primer compound must be appropriate in order to reduce environment differences and image density differences before and after standing.

In the present invention there is used a magnetic material-dispersed resin carrier core material that adsorbs moisture readily. The effect of the present invention can be elicited suitably by virtue of the fact that the amount of the primer compound lies within the above ranges, in a case where the content of the (meth)acrylic acid ester monomer having the alicyclic hydrocarbon group in the resin coating layer lies within the above ranges.

Concrete examples of the primer compound used in the present invention include for instance 3-aminopropyltrimethoxysilane and 3-aminopropyltriethoxysilane. Further examples include 3-aminopropyldiethoxymethylsilane, 3-(2-aminoethylamino)propyltrimethoxysilane, 3-(2-aminoethylamino)propyltriethoxysilane, 3-(2-aminoethylamino)propyldimethoxymethylsilane, 3-aminopropyldimethoxymethylsilane, 3-aminopropyltriethoxysilane, trimethoxy[3-(phenylamino)propyl]silane, trimethoxy[3-(methylamino)propyl]silane, [3-(N,N-dimethylamino) propyl] trimethoxysilane, N-phenyl-3-aminopropyltrimethoxysilane, N-2-(aminoethyl)-3-aminopropylmethyldimethoxysilane, N-2-(aminoethyl)-3-aminopropyltrimethoxysilane, N-2-(aminoethyl)-3-aminopropyltriethoxysilane and the like.

Preferably, the primer compound is caused to react with, and become fixed to, the core material particle surface of the magnetic carrier. As a result there can be obtained a magnetic carrier that is stable over yet longer periods of time.

Examples of methods for causing the primer compound to react with and become fixed to the surface portion of core material particles include for instance a method in which the core material particles and the primer compound are stirred while under heating.

In the present invention, the content of the resin coating layer is preferably 0.5 parts by mass to 5.0 parts by mass, more preferably 1.0 part by mass to 4.5 parts by mass, with respect to 100 parts by mass of the magnetic material-dispersed resin carrier core material. Chargeability becomes difficult to control if the amount of resin coating layer is excessively large or excessively small. The amount of the resin coating layer must be appropriate in order to reduce environment differences and image density differences before and after standing.

The coating resin A used in the resin coating layer is preferably obtained through copolymerization of a macromonomer and a (meth)acrylic acid ester monomer having an alicyclic hydrocarbon group. This has the effect of further reducing environment differences and image density differences before and after standing, and of further enhancing image density stability, as compared with not using a macromonomer in the resin coating layer. Examples of monomers that can be used in the macromonomer include, besides monomers described above as the other (meth)acrylic monomer, also styrene, acrylonitrile methacrylonitrile and the like.

Preferably, the macromonomer is a polymer obtained through polymerization of at least one, two or more types of monomers selected from the group consisting of methyl acrylate, methyl methacrylate, butyl (n-butyl, sec-butyl, iso-butyl or tert-butyl) acrylate, butyl methacrylate, 2-ethylhexyl acrylate, 2-ethylhexyl methacrylate, styrene, acrylonitrile and methacrylonitrile.

The weight-average molecular weight (Mw) of the macromonomer is preferably 2000 to 10,000, more preferably 3000 to 8000.

The content of the macromonomer is preferably 5.0 parts by mass to 50.0 parts by mass, more preferably 5.0 parts by mass to 40.0 parts by mass, with respect to 100 parts by mass as the total monomers in the coating resin A.

An instance where two or more resin compositions are used in the resin coating layer of the present invention will be explained next. In the present invention there can be used a blend of the coating resin A that is a resin obtained through polymerization (or copolymerization) of a (meth)acrylic acid ester monomer having an alicyclic hydrocarbon group, and as needed another (meth)acrylic monomer and a macromonomer, and a coating resin B having a specific acid value. Preferably, the coating resin B is a polymer of at least a monomer that includes the above other (meth)acrylic monomer. As a result, the strength of the coating film of the coating layer is increased, stable images can be output over longer periods of time, and environmental compliance is likewise enhanced.

In a case where the coating resin A and the coating resin B are used in the resin coating layer, the mass ratio of the coating resins (A:B) lies preferably in the range of 9:1 to 1:9.

As the coating resin A there is preferably used a resin obtained through copolymerization of a (meth)acrylic acid ester having an alicyclic hydrocarbon group and another (meth)acrylic monomer, or a resin obtained through copolymerization of a (meth)acrylic acid ester having an alicyclic hydrocarbon group, another (meth)acrylic monomer and a macromonomer. The acid value of the coating resin A lies preferably in the range of 0.0 mgKOH/g to 3.0 mgKOH/g, more preferably 0.0 mgKOH/g to 2.5 mgKOH/g.

In a case where a polymer of monomers including at least the above other (meth)acrylic monomer is used as the coating resin B, the acid value of the coating resin B is preferably 3.5 mgKOH/g to 50.0 mgKOH/g, more preferably 4.0 mgKOH/g to 50.0 mgKOH/g, and yet more preferably 4.5 mgKOH/g to 40.0 mgKOH/g. By virtue of the acid value lying within the above range there is enhanced the effect of reducing environment differences and image density differences before and after standing, in a case where two or more coating resins are used in the resin coating layer. The acid value of the resin can be controlled on the basis of the monomers that are used.

The weight-average molecular weight (Mw) of the coating resin B is preferably 30,000 to 120,000, more preferably 40,000 to 100,000, from the viewpoint of stability of coating.

In the present embodiment, the minimum thickness of the resin coating layer lies preferably in the range of 0.01 μm to 4.00 μm, more preferably of 0.05 μm to 3.50 μm. By virtue of the minimum thickness of the resin coating layer laying within the above ranges, the charge-imparting ability effect of the primer compound is controlled readily, and environment differences and image density differences before and after standing are easily reduced. The minimum thickness of the resin coating layer can be controlled depending on the amount of coat resin.

In the present invention, preferably, the resin coating layer does not contain a primer compound having an amino group, since the effect elicited by the present invention becomes more prominent in that case. However, a small amount of primer compound having an amino group may be incorporated in a case where chargeability needs to be adjusted. The content of the primer compound in the resin coating layer lies preferably in the range of 0 mass % to 4.0 mass %, more preferably of 0 mass % to 3.0 mass %.

The core material particles of the magnetic carrier prior to addition of the primer compound will be explained next.

The core material particles are magnetic material-dispersed resin particles each having a magnetic material and a binder resin. Examples of the magnetic material that is used in the material-dispersed resin particles include, for instance, magnetic inorganic compound particles such as: magnetic iron oxide particles such as magnetite particles, maghemite particles, and compounds that contain magnetite particles, maghemite particles and at least one type selected from the group consisting of oxides of silicon, hydroxides of silicon, oxides of aluminum and hydroxides of aluminum; magnetoplumbite type ferrite particles containing at least one element selected from the group consisting of barium and strontium; and spinel-type ferrite particles containing at least one element selected from the group consisting of manganese, nickel, zinc, lithium and magnesium. Magnetic iron oxide particles are preferred among the foregoing.

Together with the magnetic material (magnetic inorganic compound particles), there can be concomitantly used non-magnetic inorganic compound particles such as non-magnetic iron oxide particles such as hematite particles, non-magnetic hydrous ferric oxide particles such as goethite particles, and titanium oxide particles, silica particles, talc particles, alumina particles, barium sulfate particles, barium carbonate particle, cadmium yellow particles, calcium carbonate particles and zinc oxide particles.

In a case where magnetic inorganic compound particles and non-magnetic inorganic compound particles are used concomitantly, a preferred mixing proportion of the foregoing involves 30 mass % or more of magnetic inorganic compound particles with respect to the total mass of both kinds of particles.

In the present invention, preferably, part or the entirety of the magnetic inorganic compound particles and the non-magnetic inorganic compound particles is treated with a lipophilic treatment agent.

Examples of lipophilic treatment agents include, for instance, organic compounds having at least one type of functional group selected from the group consisting of epoxy groups, amino groups, mercapto groups, organic acid groups, ester groups, ketone groups, halogenated alkyl groups and aldehyde groups, and mixtures of such organic compounds.

A coupling agent is preferably used as the organic compound having a functional group. Silane coupling agents, titanium coupling agents and aluminum coupling agents are more preferable among coupling agents. Silane coupling agents are yet more preferable among the foregoing.

A thermosetting resin is preferably used as the binder resin that is utilized in the core material particles.

Examples of thermosetting resins include, for instance, phenolic resins, epoxy resins, polyester resins (for example, unsaturated polyester resins) and the like. Phenolic resins are preferred among the foregoing in terms of ease of production and cost affordability. Examples of phenolic resins include, for instance, phenol-formaldehyde resins.

Preferably, the proportion of the binder resin that makes up the core material particles (magnetic material-dispersed resin particles) is 1 mass % to 20 mass % with respect to the total mass of the magnetic material-dispersed resin particles. The proportion of the magnetic material (magnetic inorganic compound particles) and, as needed, the non-magnetic inorganic compound particles, is preferably 80 mass % to 99 mass % with respect to the total mass of the magnetic material-dispersed resin particles.

A method for producing the core material particles (magnetic material-dispersed resin particles) will be explained next.

In a method for producing the magnetic material-dispersed resin particles, firstly a phenol and an aldehyde are charged in an aqueous medium, in the presence of a magnetic material (for instance, magnetic inorganic compound particles and, as needed, non-magnetic inorganic compound particles) and a basic catalyst, with stirring. Thereafter, magnetic material-dispersed resin particles containing a magnetic material and a phenolic resin can be produced by causing the phenol and the aldehyde to react, to elicit curing.

Magnetic material-dispersed resin particles can also be produced for instance in accordance with a so-called kneading-crushing method that involves crushing a resin containing a magnetic material. The former method is preferred herein from the viewpoint of ease of control of the particle size of the magnetic carrier, and of achieving a sharp particle size distribution in the magnetic carrier.

A toner that is used in combination with the magnetic carrier of the present invention will be explained next.

The toner comprises toner particles and as needed an external additive (inorganic microparticles). Each toner particle contains a binder resin, (binder resin of the toner particle) and, as needed, a coloring agent and a release agent.

Examples of the binder resin as used in the toner particle include, for instance, vinyl resins, polyesters, epoxy resins and the like. Vinyl resins and polyesters are preferred among the foregoing from the viewpoint of chargeability and fixability.

In the present invention, the binder resin may be used after being mixed with, as needed, a homopolymer or copolymer of vinylic monomers, or a polyester, a polyurethane, an epoxy resin, polyvinyl butyral, rosin, modified rosin, a terpene resin, a phenolic resin, an aliphatic or alicyclic hydrocarbon resin or an aromatic petroleum resin.

When using a mixture of two or more resins as the binder resin of the toner particle it is preferable to use a mixture of resins having dissimilar molecular weights.

The glass transition temperature of the binder resin is preferably 45° C. to 80° C.

The number-average molecular weight (Mn) of the binder resin is preferably 2500 to 50,000.

The weight-average molecular weight (Mw) of the binder resin is preferably 10,000 to 1,000,000.

When using a polyester in the binder resin, the alcohol component in the polyester is preferably 45 mol % to 55 mol %, and the acid component 45 mol % to 55 mol %, with respect to all the polyester components.

The acid value of the polyester is preferably 90 mgKOH/g or lower, more preferably 50 mgKOH/g or lower. The hydroxyl value of the polyester is preferably 50 mgKOH/g or lower, more preferably 30 mgKOH/g or lower. That is because the environment dependence of the charging characteristic of the toner tends to decrease with decreasing number of terminal groups of the molecular chain of the polyester.

The glass transition temperature of the polyester lies preferably in the range of 45° C. to 75° C.

The number-average molecular weight (Mn) of the polyester is preferably 1500 to 50,000, more preferably 2000 to 20,000.

The weight-average molecular weight (Mw) of the polyester is preferably 6000 to 100,000, more preferably 10,000 to 90,000.

When a magnetic toner is used as a the toner, examples of magnetic body in the magnetic toner particle that makes up the magnetic toner include, for instance, iron oxides such as magnetite, maghemite and ferrite, iron oxides containing other metal oxides, as well as metals such as Fe, Co and Ni, alloys of the foregoing metals with metals such as Al, Co, Cu, Pb, Mg, Ni, Sn, Zn, Sb, Be, Bi, Cd, Ca, Mn, Se, Ti, W and V, and mixtures of the foregoing.

Specific examples include, for instance, ferrosoferric oxide ($Fe_3O_4$), ferric oxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron (Fe), cobalt (Co), nickel (Ni) and the like.

The content of the magnetic body in the magnetic toner particle is preferably 20 parts by mass to 150 parts by mass, more preferably 50 parts by mass to 130 parts by mass, and yet more preferably 60 parts by mass to 120 parts by mass, with respect to 100 parts by mass of the binder resin in the magnetic toner particle.

Non-magnetic coloring agents that can be used in the toner particle include for instance the following are exemplified next.

Examples of coloring agents for black toner include carbon black and coloring agents adjusted to black using a yellow coloring agent, a magenta coloring agent and a cyan coloring agent.

Examples of coloring agent for magenta toner include condensed azo compounds, diketopyrrolopyrrole compounds, anthraquinone compounds, quinacridone compounds, basic dye lake compounds, naphthol compounds, benzimidazolone compounds, thioindigo compounds and perylene compounds.

Specific examples include pigments such as C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 144, 146, 150, 163, 166, 169, 177, 184, 185, 202, 206, 207, 209, 220, 221, 238, 254, 269, C. I. Pigment Violet 19, C. I. Vat Red 1, 2, 10, 13, 15, 23, 29, 35 and the like.

Examples of coloring agents for magenta toner include, for instance, oil-soluble dyes such as C. I. Solvent Red 1, 3, 8, 23, 24, 25, 27, 30, 49, 81, 82, 83, 84, 100, 109, 121, C. I. Disperse Red 9, C. I. Solvent Violet 8, 13, 14, 21, 27, C. I. Disperse Violet 1 and the like, and basic dyes such as C. I. Basic Red 1, 2, 9, 12, 13, 14, 15, 17, 18, 22, 23, 24, 27, 29, 32, 34, 35, 36, 37, 38, 39, 40, C. I. Basic Violet 1, 3, 7, 10, 14, 15, 21, 25, 26, 27, 28 and the like.

Examples of coloring agents for cyan toner include, for instance, pigments such as C. I. Pigment Blue 1, 2, 3, 7, 15:2, 15:3, 15:4, 16, 17, 60, 62, 66, C. I. Vat Blue 6, C. I.

Acid Blue 45, copper phthalocyanine pigments obtained by substituting one to five phthalimidomethyl groups in a phthalocyanine skeleton.

Examples of coloring agents for yellow toner include, for instance, pigments such as condensed azo compounds, isoindolinone compounds, anthraquinone compounds, azo metal compounds, methine compounds, allylamide compounds and the like. Specific examples include C. I. Pigment Yellow 1, 2, 3, 4, 5, 6, 7, 10, 11, 12, 13, 14, 15, 16, 17, 23, 62, 65, 73, 74, 83, 93, 95, 97, 109, 110, 111, 120, 127, 128, 129, 147, 155, 168, 174, 180, 181, 185, 191, and C.I. Vat Yellow 1, 3, 20 and the like.

Further examples of coloring agents for yellow toner include, for instance, dyes such as C. I. Direct Green 6, C. I. Basic Green 4, C. I. Basic Green 6, C. I. Solvent Yellow 162 and the like.

As the coloring agent there may be used a pigment alone; alternatively, a pigment and a dye may be used concomitantly from the viewpoint of enhancing vividness and enhancing the image quality of a full color image.

The content of the coloring agent in the toner particle is preferably 0.1 parts by mass to 30 parts by mass, more preferably 0.5 parts by mass to 20 parts by mass, and yet more preferably 3 parts by mass to 15 parts by mass, with respect to 100 parts by mass of the binder resin in the toner particle.

To produce the toner particle there is preferably used a product (coloring agent masterbatch) obtained by mixing beforehand the coloring agent with the binder resin to yield a masterbatch. The coloring agent can then be dispersed satisfactorily into the toner particle through melting and kneading of the coloring agent masterbatch and other starting materials (binder resin, wax and the like).

A charge control agent can be incorporated as needed into the toner particle in the toner, in order to stabilize the chargeability of the toner particle.

The content of the charge control agent in the toner particle ranges preferably from 0.5 parts by mass to 10 parts by mass with respect to 100 parts by mass of the binder resin in the toner particle. Fuller charging characteristics are obtained if the content of the charge control agent is 0.5 parts by mass or greater. If the content of the charge control agent is 10 parts by mass or lower, compatibility with other materials is less prone to drop, and charging is not prone to be excessive.

Examples of negative chargeability control agents that control a toner particle to negative chargeability include for instance organometallic complexes, chelate compounds and the like. Specific examples include monoazo metal complexes, metal complexes of aromatic hydroxycarboxylic acids, and metal complexes of aromatic dicarboxylic acids. Other examples include for instance aromatic hydroxycarboxylic acids, aromatic monocarboxylic acids, aromatic polycarboxylic acids, metal salts of the foregoing, anhydrides of the foregoing, and esters of the foregoing, and phenol derivatives such as bisphenol.

Examples of positive chargeability control agents that control the toner particle to positive chargeability include for instance nigrosine or modified products thereof with fatty acid metal salts or the like; quaternary ammonium salts such as tributylbenzylammonium-1-hydroxy-4-naphthosulfonate, tetrabutylammonium tetrafluoroborate and the like; onium salts such as phosphonium salts; triphenylmethane dyes; lake pigments of the foregoing (laking agents include for instance phosphotungstic acid, phosphomolybdic acid, phosphotungstic molybdic acid, tannic acid, lauric acid, gallic acid, ferricyanide acid, ferrocyanide compounds and the like), diorganotin oxides such as dibutyltin oxide, dioctyltin oxide, dicyclohexyltin oxide and the like, and diorganotin borates such as dibutyltin borate, dioctyltin borate, dicyclohexyltin borate and the like.

One or more types of release agent may be incorporated, as needed, into the toner particle.

Examples of the release agent include for instance aliphatic hydrocarbon waxes such as low molecular weight polyethylene, low molecular weight polypropylene, microcrystalline wax, and paraffin wax and the like.

Further examples of the release agent include for instance oxides of aliphatic hydrocarbon-based waxes such as polyethylene oxide wax, or block copolymers thereof; waxes having a fatty acid ester as a main component, for instance carnauba wax, Sasol wax, montanic acid ester waxes and the like; and waxes obtained through partial or total deoxidation of a fatty acid ester, for instance deoxidated carnauba wax.

The content of the release agent in the toner particle is preferably 0.1 parts by mass to 20 parts by mass, more preferably 0.5 parts by mass to 10 parts by mass, with respect to 100 parts by mass of the binder resin in the toner particle.

The melting point of the release agent, defined as a maximum endothermic peak temperature during temperature rising as measured using a differential scanning calorimeter (DSC), is preferably 65° C. to 130° C., more preferably 80° C. to 125° C. If the melting point is 65° C. or higher, toner viscosity is less prone to drop, and the toner does not adhere readily onto an electrophotographic photoconductor. If the melting point is 130° C. or lower there is obtained sufficient low-temperature fixability.

The toner particle can contain a crystalline polyester, as needed.

Preferably, the crystalline polyester is obtained through condensation polymerization of an aliphatic diol having 6 to 12 carbon atoms and an aliphatic dicarboxylic acid having 6 to 12 carbon atoms. Preferably, the aliphatic diol and the aliphatic dicarboxylic acid are saturated, and are preferably linear. Herein, crystallinity signifies that there is observed a distinctive endothermic peak in a reversible specific heat change curve of a specific heat change measurement using a differential scanning calorimeter (DSC).

An external additive (flowability-enhancing agent) can be added externally to the toner particle, in terms of enhancing flowability and the like.

Examples of external additives include for instance fluorine atom-containing resin particles such as vinylidene fluoride particles, polytetrafluoroethylene particles and the like; and inorganic particles including silica particles such as silica particles produced in accordance with a wet method, silica particles produced in accordance with a dry method, and titanium oxide particles, alumina particles and the like. Preferably, the inorganic particles have undergone a hydrophobic treatment in which the surface of the particles is treated with a silane coupling agent, a titanium coupling agent, silicone oil or the like. Specifically, preferred inorganic oxide particles have been treated in such a manner that the degree of hydrophobicity of the particles as measured according to a methanol titration test takes on a value in the range of 30 to 80.

The content of the external additive in the toner is preferably 0.1 parts by mass to 10 parts by mass, more preferably 0.2 parts by mass to 8 parts by mass with respect to 100 parts by mass of the toner particle.

The magnetic carrier of the present invention can be used as a two-component developer that contains a magnetic carrier and a toner that comprises a toner particle containing a binder resin, and as needed a coloring agent and a release agent. In a case where the magnetic carrier of the present invention is used as a two-component developer by being mixed with a toner, the content of the toner (toner concentration) in the two-component developer is preferably 2 mass % to 15 mass %, more preferably 4 mass % to 13 mass %. If the content of the toner is 2 mass % or higher, the density of the output image is less prone to drop, and if the content of the toner is 15 mass % or lower, fogging of the output image does not occur readily, and spattering of the toner inside the image forming apparatus (machine spattering) is less prone to occur.

The two-component developer having the magnetic carrier of the present invention can be used in an image formation method that has a charging step of charging an electrostatic latent image bearing member, an electrostatic latent image formation step of forming an electrostatic latent image on the surface of the electrostatic latent image bearing member, a developing step of forming a toner image by developing the electrostatic latent image using a two-component developer, a transfer step of transferring the toner image to a transfer material via or not via an intermediate transfer member, and a fixing step of fixing the transferred toner image to the transfer material.

In the above image formation method, the magnetic carrier of the present invention can be used in a replenishment developer that is replenished to the developing device in response to a decrease in the toner concentration of the two-component developer in the developing device. The above image formation method may include a feature wherein excess magnetic carrier within the developing device is discharged, as needed, from the developing device.

Preferably, the replenishment developer contains a replenishment magnetic carrier, and a toner comprising a toner particle that contains a binder resin, and as needed, a coloring agent and a release agent. Preferably, the replenishment developer contains 2 parts by mass to 50 parts by mass of the toner particle with respect to 1 part by mass of the replenishment magnetic carrier. The replenishment developer need not have the replenishment magnetic carrier, and may be toner alone.

An explanation follows next on an image forming apparatus (electrophotographic apparatus) that is provided with a two-component developer having a magnetic carrier and with a replenishment developer.

(Image Formation Method)

In FIG. 1, an electrophotographic photoconductor 1, being an electrostatic latent image bearing member, rotates in the direction of the arrow in FIG. 1. The surface of the electrophotographic photoconductor 1 is charged by a charger 2, being a charging means, and the surface of the charged electrophotographic photoconductor 1 is irradiated with image exposure light by an image exposure device 3, being an image exposure means (electrostatic latent image forming means), whereupon an electrostatic latent image becomes formed on the surface. A developing device 4, being a developing means, has a developing container 5 that accommodates a two-component developer.

A developer carrier 6 in the developing device 4 is disposed in a rotatable state. The developer carrier 6 has built thereinto magnets 7 as a magnetic field generating means. At least one of the magnets 7 is disposed so as to be positioned opposing the electrophotographic photoconductor 1. The two-component developer is held on the developer carrier 6 by the magnetic field of the magnets 7, the amount of the two-component developer is regulated by a regulating member 8, and the two-component developer is transported to a development portion opposing electrophotographic photoconductor 1. At the development portion a magnetic brush is formed by the magnetic field generated by the magnets 7.

Thereafter, developing bias resulting from superposing an alternating electric field onto a DC electric field is applied to the developer carrier, as a result of which the electrostatic latent image becomes developed (visualized) in the form of a toner image. The toner image formed on the surface of the electrophotographic photoconductor 1 is electrostatically transferred to a recording medium (transfer material) 12 by a transfer charger 11 being a transfer means.

Figure 2:
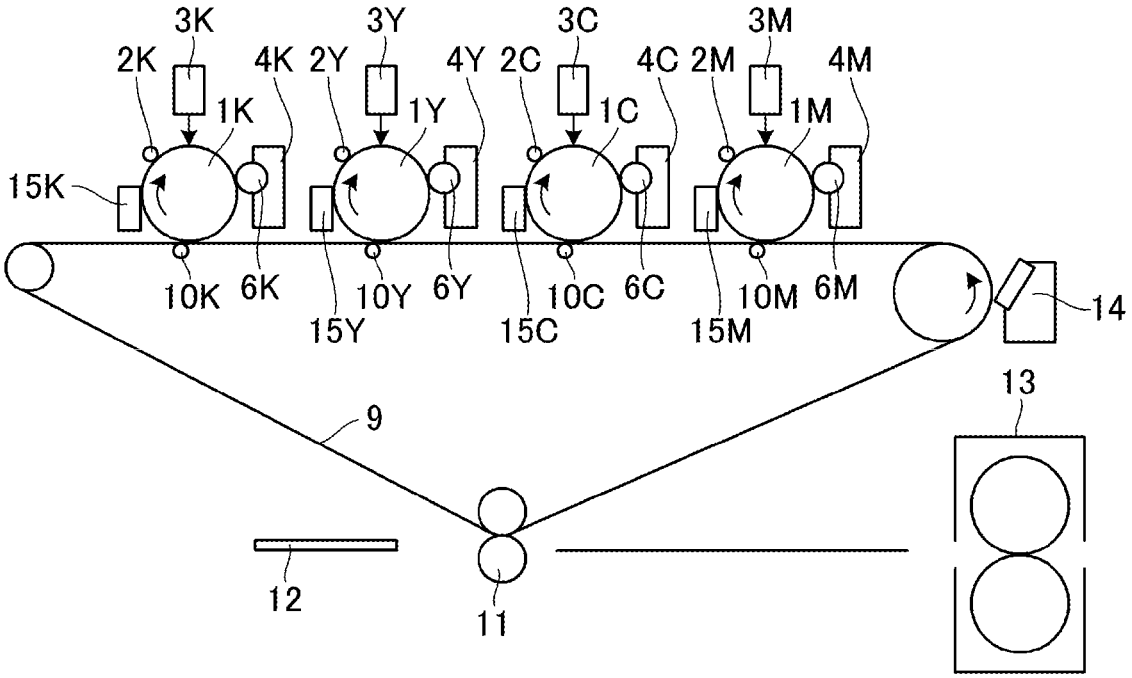
FIG. 2 is a schematic diagram of an image forming apparatus that can be used in the present invention.

As illustrated in FIG. 2, the toner image may be temporarily transferred (primary transfer) from the electrophotographic photoconductor 1 to an intermediate transfer member 9, and is thereafter electrostatically transferred (secondary transfer) to the recording medium 12. Thereafter, the recording medium 12 is transported to a fixing device 13, being a fixing means, where the toner is fixed to the recording medium 12 through heating and pressing. The recording medium 12 is discharged thereafter out of the image forming apparatus in the form of an output image.

After the transfer step, toner (transfer residual toner) remaining on the surface of the electrophotographic photoconductor 1 is removed by a cleaner 15, being a cleaning means. Thereafter, the surface of the electrophotographic photoconductor 1 having been cleaned by the cleaner 15 is irradiated with pre-exposure light from a pre-exposure device 16, being a pre-exposure means, as a result of which the surface of the electrophotographic photoconductor 1 is initialized electrically. The above image forming operation is then repeated.

FIG. 2 illustrates an example of a schematic diagram in which the image formation method of the present invention is used in a full color image forming apparatus.

In FIG. 2, K denotes black, Y denotes yellow, C denotes cyan and M denotes magenta. In FIG. 2 electrophotographic photoconductors 1K, 1Y, 1C, 1M rotate in the direction of the arrows in FIG. 2. The surface of the electrophotographic photoconductors 1K, 1Y, 1C, 1M of the respective colors is charged by respective chargers 2K, 2Y, 2C, 2M, as a charging means. The surfaces of the charged electrophotographic photoconductors 1K, 1Y, 1C, 1M for each color is irradiated with image exposure light by respective image exposure devices 3K, 3Y, 3C, 3M, being an image exposure means (electrostatic latent image forming means), whereupon respective electrostatic latent images become formed on the surface of the electrophotographic photoconductors 1K, 1Y, 1C, 1M.

Thereafter, the electrostatic latent images are developed (visualized) in the form of toner images by two-component developers that are supported on developer carriers 6K, 6Y, 6C, 6M that are provided in developing devices 4K, 4Y, 4C, 4M being a developing means. The toner images are transferred (primary transfer) to an intermediate transfer member 9 by primary transfer chargers 10K, 10Y, 10C, 10M, being a primary transfer means. The toner images are transferred (secondary transfer) to a recording medium 12 by a secondary transfer charger 21, being a secondary transfer means. Thereafter, the recording medium 12 is transported to a fixing device 13, being a fixing means, where the toner is fixed to the recording medium 12 through heating and pressing.

Thereafter, the recording medium 12 is discharged out of the image forming apparatus in the form of an output image. After the secondary transfer step, the transfer residual toner and so forth is removed by an intermediate transfer member cleaner 14, being a cleaning means, of the intermediate transfer member 9. After the primary transfer step, the toner remaining on the surface of the electrophotographic photoconductors 1K, 1Y, 1C, 1M is removed by cleaners 15K, 15Y, 15C, 15M being a cleaning means.

Preferably, as a developing method in which the two-component developer of the present invention is utilized, developing is carried out in a state where the magnetic brush is in contact with the electrophotographic photoconductor while an alternating electric field is formed at a development portion, through application AC voltage to the developer carrier. Preferably, the distance (S-D distance) between the developer carrier (developing sleeve (S)) 6 and the electrophotographic photoconductor (photoconductor drum (D)) lies preferably in the range of 100 μm to 1000 μm from the viewpoint of preventing carrier adhesion and enhancing dot reproducibility. If the distance is 100 μm or greater, the two-component developer is supplied sufficiently, and the density of the output image is less prone to drop. If the distance is 1000 μm or smaller, magnetic force lines do not spread readily from a magnetic pole S1, the density of the magnetic brush is less prone to drop, and dot reproducibility is likewise less prone to drop. Further, the forces that constrain the magnetic carrier are less prone to weaken, and adhesion of the magnetic carrier is less prone to occur.

The voltage (Vpp) across peaks of alternating electric field is preferably 300 V to 3000 V, more preferably 500 V to 1800 V. The frequency of the alternating electric field is preferably 500 Hz to 10,000 Hz, more preferably 1000 Hz to 7000 Hz. In this case, the waveform of AC bias for forming the alternating electric field is for instance a triangle wave, a square wave, a sine wave, or a waveform with altered duty ratio. In order to respond to changes in the formation rate of the toner image, developing is preferably carried out through application, to the developer carrier, of a developing bias voltage (intermittent alternating superimposed voltage) having a non-continuous AC bias voltage. If the applied voltage is 300 V or higher sufficient image density is readily obtained, and fogging toner at non-image portions is recovered readily. If the applied voltage is 3000 V or lower, disturbance of the electrostatic latent image by the magnetic brush is not prone to occur.

By using a two-component developer having appropriately charged toner it becomes possible to lower a fogging-removal voltage (Vback) and to reduce the primary charging of the electrophotographic photoconductor. The service life of the electrophotographic photoconductor can be prolonged as a result. Herein Vback is preferably 200 V or lower, more preferably 150 V or lower. Contrast potential lies preferably in the range of 100 V to 400 V, so that sufficient image density can be achieved.

If the frequency is 500 Hz or higher there can be used an electrophotographic photoconductor that is utilized in an ordinary image forming apparatus (electrophotographic apparatus). Examples of the electrophotographic photoconductor include for instance an electrophotographic photoconductor having a configuration resulting from providing a conductive layer, a subbing layer, a charge generation layer and a charge transport layer, in this order, on a conductive support of aluminum, SUS or the like. A protective layer can be provided, as needed, on the charge transport layer.

Layers ordinarily used in electrophotographic photoconductors can be used herein as the conductive layer, the subbing layer, the charge generation layer and the charge transport layer.

(Measurement Method of the Volume Average Particle Size (D50) of the Magnetic Carrier and the Magnetic Carrier Core Material)

The particle size distribution and so forth were measured using a particle size distribution measuring device (trade name: Microtrac MT3300EX, by Nikkiso Co., Ltd.).

The volume average particle size (D50) of the magnetic carrier and the magnetic carrier core material was measured through fitting of a sample feeder for dry measurement (trade name: One-shot dry-type sample conditioner Turbotrac, by Nikkiso Co., Ltd.). The supply conditions of Turbotrac included using a dust collector as a vacuum source, airflow set to 33 1/sec and pressure set to 17 kPa. Control was carried out automatically by software. The particle size was worked out as 50% particle size (D50), being a cumulative value of volume average. Control and analysis were performed using the ancillary software (Version 10.3.3-202D). The measurement conditions were as follows.

Set Zero time: 10 seconds
Measurement time: 10 seconds
Measurements: one
Particle refractive index: 1.81
Particle shape: non-spherical
Measurement upper limit: 1408 μm
Measurement lower limit: 0.243 μm
Measurement environment: temperature 23° C./humidity 50% RH (Measurement Method of Weight-Average Particle Size (D4) and Number-Average Particle Size (D1) of Toner)

A precision particle size distribution measuring device (trade name: COULTER COUNTER Multisizer 3, by Beckman Coulter, Inc.) relying on a pore electrical resistance method and provided with a 100 μm aperture tube, as well as ancillary dedicated software for setting measurement conditions and analyzing measurement data (trade name: Beckman Coulter Multisizer 3, Version 3.51, by Beckman Coulter, Inc.), were used to measure the weight-average particle size (D4) and the number-average particle size (D1) of the toner. The actual measurement channel number was set to 25,000 channels, and measurement data was analyzed and computed.

A solution resulting from dissolving special-grade sodium chloride in deionized water to a concentration of 1 mass % (trade name: ISOTON II, by Beckman Coulter, Inc.) was used as the aqueous electrolyte solution utilized in the measurement.

Setting of the dedicated software was carried out, as follows, before measurement and analysis.

In a "modification screen of a standard measurement method (SOM)" of the dedicated software the total count in a control mode was set to 50,000 particles, the number of measurements was set to one, and a Kd value was set to a value obtained using "standard particle 10.0 μm" (by Beckman Coulter, Inc.). A threshold value and a noise level were automatically set through pressing of a measurement button of threshold value/noise level. The current was set to 1600 μA, the gain was set to 2, the electrolyte solution was set to "ISOTON II", and flushing of the aperture tube after measurement was ticked off.

In a "screen for setting conversion from pulses to particle size" of the dedicated software, a bin interval was set to logarithmic particle size, the number of particle size bins was set to 256, and the particle size range was set to 2 μm to 60 μm.

The specific measuring method is as follows.

(1) Herein 200 ml of the above aqueous electrolyte solution were charged in a 250 ml round-bottom glass beaker designed for use with "Multisizer 3", the beaker was placed on a sample stand, and conditioning was performed through counterclockwise stirring at 24 rotations per second, using a stirrer rod. Dirt and bubbles within the aperture tube were removed with the help of an "aperture flush" function of the dedicated software.

(2) Then 30 ml of the above aqueous electrolyte solution were charged in a 100 ml flat-bottom glass beaker. To the aqueous electrolyte solution there were added 0.3 ml of a diluted solution of a dispersant (trade name: "Contaminon N" by Wako Pure Chemical Industries, Ltd.) diluted threefold (in mass ratio) with deionized water. Herein "Contaminon N" is a 10 mass % aqueous solution, at pH 7, of a detergent for cleaning precision measurement instruments, the detergent being made up of a nonionic surfactant, an anionic surfactant and an organic builder.

(3) A predetermined amount of deionized water was charged in the water tank of an ultrasonic dispersion device (trade name: Ultrasonic Dispersion System Tetra 150, by Nikkaki Bios Co., Ltd.) having an electrical output of 120 W and having built thereinto two oscillators having an oscillation frequency of 50 kHz and phases mutually offset by 180°. Then 2 ml of "Contaminon N" were added to the water tank.

(4) The beaker in (2) above was set in a beaker fixing hole of the above ultrasonic dispersion device and the ultrasonic dispersion device was operated. The height position of the beaker was adjusted in such a manner that the resonant state of the liquid level of the aqueous electrolyte solution in the beaker was maximal.

(5) Then about 10 mg of the toner were added, in small aliquots, to the aqueous electrolyte solution of (4) above in the beaker, while the aqueous electrolyte solution was irradiated with ultrasounds, to disperse the toner. The ultrasonic dispersion treatment was continued for 60 seconds. The water temperature in the water tank was appropriately controlled during ultrasonic dispersion so as to lie in the range of 10° C. to 40° C.

(6) The aqueous electrolyte solution of (5) having the toner dispersed therein was added drop-wise, using a pipette, to the round-bottom beaker of (1) above that had been disposed in the sample stand, and the measured concentration was adjusted to 5%. The measurement was then performed until the number of measured particles reached 50,000.

(7) The measurement data was analyzed using the above-mentioned dedicated software ancillary to the apparatus, to calculate the weight-average particle diameter (D4) and the number-average particle size (D1). The "average size" displayed in an analysis/volume statistical value (arithmetic mean) screen, with graph/volume % as set in the dedicated software, corresponds herein to the weight-average particle diameter (D4). The "average size" displayed in an analysis/number statistical value (arithmetic mean) screen, with graph/number % as set in the dedicated software, corresponds herein to the number-average particle size (D1).

(Acid Value Measurement Method)

The acid value is the number of mg of potassium hydroxide necessary to neutralize the acid in 1 g of sample. Specifically, the acid value denotes the number of mg of potassium hydroxide required to neutralize free fatty acids, resin acids and so forth contained in 1 g of sample.

The acid value of the present invention is measured in accordance with JIS K 0070-1992. The measurement is performed specifically according to the procedure below.

(1) Reagent Preparation

A phenolphthalein solution is obtained by dissolving 1.0 g of phenolphthalein in 90 mL of ethyl alcohol (95 vol %) and adding deionized water, to a total amount of 100 mL.

Further, 7 g of special-grade potassium hydroxide are dissolved in 5 mL of water, and ethyl alcohol (95 vol %) is added thereto, to a total of 1 L. The resulting solution is placed in an alkali-resisting vessel in such a way so as not to come into contact with carbon dioxide gas and the like, is left to stand for 3 days, and is filtered thereafter to yield a potassium hydroxide solution. The obtained potassium hydroxide solution is stored in an alkali-resisting vessel. To work out the factor of the potassium hydroxide solution, 25 mL of 0.1 mol/L hydrochloric acid are placed in an Erlenmeyer flask, several drops of the phenolphthalein solution are added thereto, and the resulting solution is titrated with the potassium hydroxide solution. The factor is then worked out on the basis of the amount of the potassium hydroxide solution necessary for neutralization. The 0.1 mol/L hydrochloric acid that is used is prepared according to JIS K 8001-1998.

(2) Operation (A) Main Test

A sample in an amount of 2.0 g is placed in a 200 mL Erlenmeyer flask; thereupon, 100 mL of a mixed solution of toluene/ethanol (2:1) are added thereto, to dissolve the sample over 5 hours. Next, several drops of the above phenolphthalein solution are added as an indicator, and the resulting solution is titrated using the above potassium hydroxide solution. The end point of the titration is herein the point in time by which the pale red color of the indicator has persisted for about 30 seconds.

(B) Blank Test

Titration is performed in the same manner as described above but herein no sample is used (i.e. only the mixed solution of toluene/ethanol (2:1) is used).

(3) Calculation of the Acid Value

The acid value is calculated by substituting the obtained results in the following expression.

$$AV=[(B-A)\times f\times 5.61]/S$$

In the expression, AV is the acid value (mgKOH/g), A is the amount (mL) of potassium hydroxide solution added in the blank test, B is the amount (mL) of potassium hydroxide solution added in the main test, f is the factor of the potassium hydroxide solution, and S is the weight (g) of the sample.

(Separation of the Resin Coating Layer from the Magnetic Carrier and Fractionation of the Coating Resins A and B in the Resin Coating Layer)

Methods for separating the coating layer from the magnetic carrier include a method that involves placing the magnetic carrier in a cup and eluting the coating resin using toluene.

The eluted resin is fractionated using the apparatus below.

[Apparatus Configuration]

LC-908 (Japan Analytical Industry Co., Ltd.)

JRS-86 (Repeat Injector, by Japan Analytical Industry Co., Ltd.)

JAR-2 (Auto-sampler, by Japan Analytical Industry Co., Ltd.)

FC-201 (Fraction Collector, by Gilson, Inc.)

[Column Configuration]

JAIGEL-1H-5H (20×600 mm; fractionation column) (Japan Analytical Industry Co., Ltd.)

[Measurement Conditions]

Temperature: 40° C.

Solvent: THF

Flow rate: 5 ml/min

Detector: RI

In the fractionation method, molecular weight distribution of the coating resin is measured beforehand in accordance with the method below, and respective elution times corresponding to the peak molecular weight (Mp) of the coating resin A and of the coating resin B are measured. The resin components are fractionated before and after the elution time. Thereafter, the solvent is removed, and the resins are dried to yield coating resin A and coating resin B. The resin configuration of the coating resin A and the coating resin B is elucidated by identifying atomic groups on the basis of absorption wavenumbers, using a Fourier transform infrared spectrometer (Spectrum One, by Perkin Elmer Inc.).

(Measurement of the Weight-Average Molecular Weight (Mw), Peak Molecular Weight (Mp) and Content Ratio of the Coating Resin A, the Coating Resin B and the Coating Resin in the Resin Coating Layer)

The weight-average molecular weight (Mw), peak molecular weight (Mp) of the coating resin A, the coating resin B and the coating resin were measured in accordance with the procedure below, by gel permeation chromatography (GPC).

Firstly, measurement samples were produced as follows.

The sample (coating resin separated from the magnetic carrier, or coating resin A or coating resin B fractionated in the fractionation apparatus) and tetrahydrofurane (THF) were mixed, to a concentration of 5 mg/ml, the resulting sample was left to stand for 24 hours at room temperature, and the sample was dissolved in THF. Thereafter, the sample was run through a sample treatment filter (Sample Pretreatment Cartridge H-25-2, by Tosoh Corporation, EKICRODISK 25CR, by Gelman Science Japan Ltd.), to yield a filtrate as the sample for GPC.

Next, measurements were performed under the measurement conditions below, using a GPC measuring device (HLC-8120 GPC by Tosoh Corporation), in accordance with the operating manual accompanying the apparatus.

(Measurement Conditions)

Apparatus: High-speed GPC "HLC8120 GPC" (Tosoh Corporation)

Column: 7-column train Shodex KF-801, 802, 803, 804, 805, 806, 807 (Showa Denko K.K.)

Eluent: THF

Flow rate: 1.0 ml/min

Oven temperature: 40.0° C.

Sample injection amount: 0.10 ml

To calculate the weight-average molecular weight (Mw) and the peak molecular weight (Mp) there was used a molecular weight calibration curve constructed using a standard polystyrene resin (TSK Standard Polystyrene F-850, F-450, F-288, F-128, F-80, F-40, F-20, F-10, F-4, F-2, F-1, A-5000, A-2500, A-1000, A-500, by Tosoh Corporation).

Figure 3:
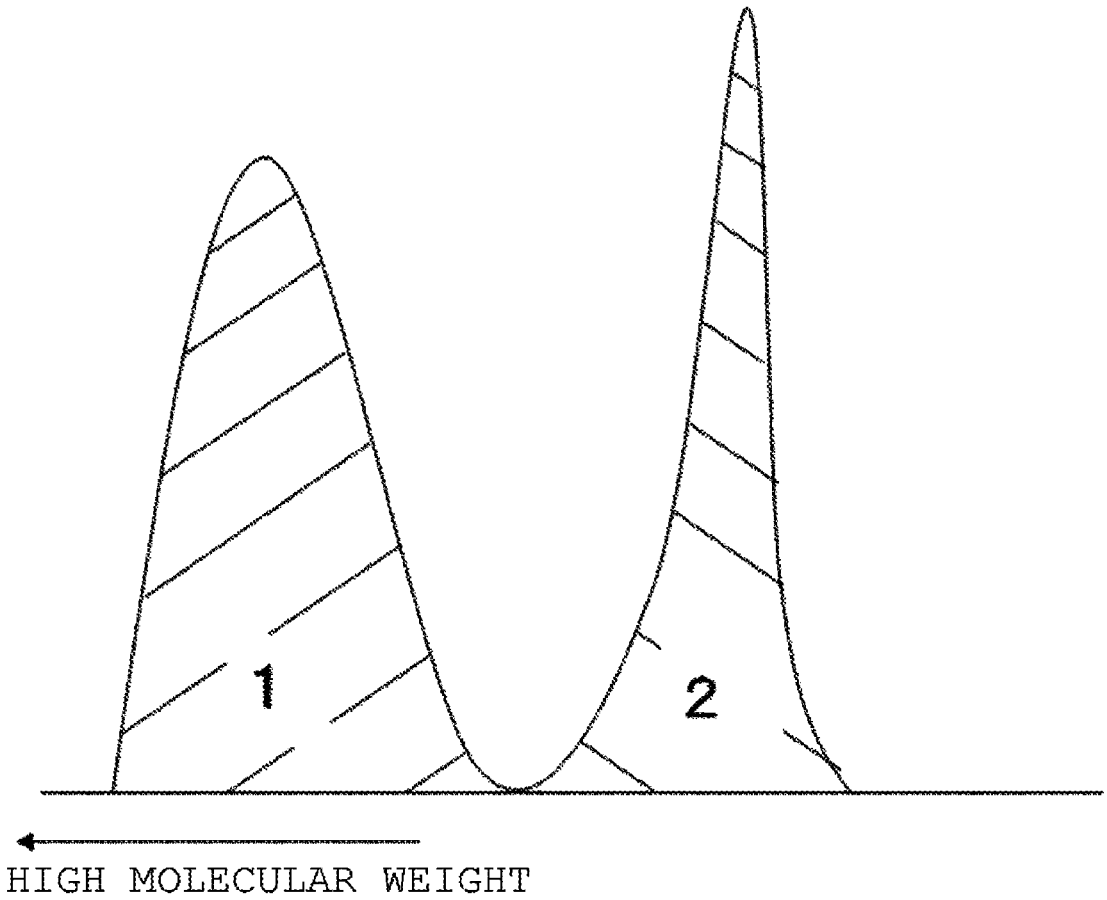
FIG. 3 is a schematic diagram of a coat resin content regulation method in a GPC molecular weight distribution curve.
Figure 4:
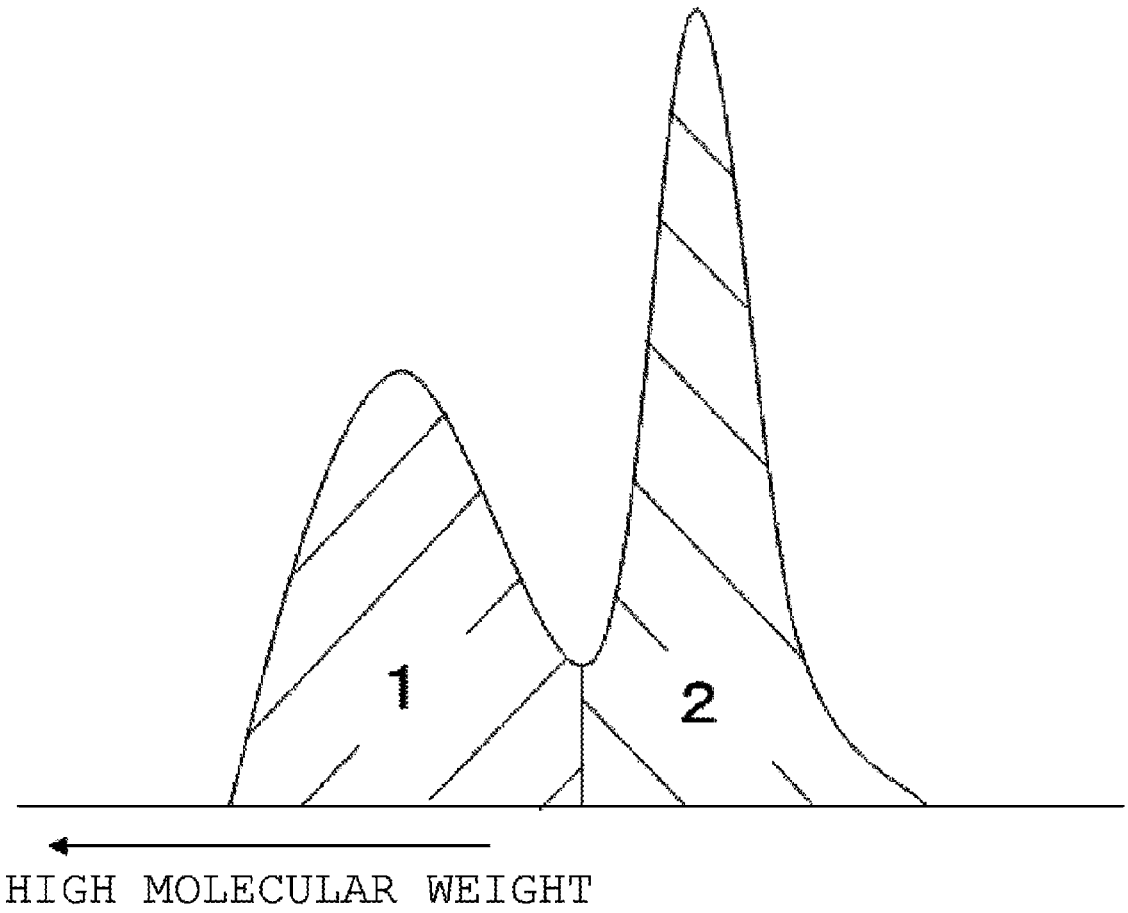
FIG. 4 is a schematic diagram of a coat resin content regulation method in a GPC molecular weight distribution curve.

The content ratio was worked out on the basis of a peak area ratio in the molecular weight distribution measurement. Where region 1 and region 2 were completely separated, as illustrated in FIG. 3, the content ratio of the resins was worked out on the basis of the area ratio between the regions. Where regions overlapped, as illustrated in FIG. 4, a dividing line was drawn perpendicularly from the inflection point of the GPC molecular weight distribution curve up to the horizontal axis, and the content ratio was worked out on the basis of the area ratio of region 1 and region 2 illustrated in FIG. 4.

(Measurement of Magnetization Amount)

The magnetization amount can be worked out using an oscillating magnetic field-type magnetic characteristic apparatus VSM. Examples of oscillating magnetic field-type magnetic characteristic apparatuses include the oscillating magnetic field-type magnetic characteristic automatic recording apparatus BHV-30 by Riken Denshi Co., Ltd. The measurement is carried out using this apparatus, in accordance with the procedure below. The carrier is packed sufficiently densely into a cylindrical plastic container, an external magnetic field of 79.6 (kA/m) (1000 Oe) is generated, and the magnetization moment of the carrier packed into the container is measured in this state. The actual mass of the carrier packed into the container is measured, and the intensity ($Am^2/kg$) of the magnetization of the carrier is worked out.

(Measurement of the Content of the Primer Compound in the Magnetic Material-Dispersed Resin Carrier Core Material)

To measure the content of the primer compound in the magnetic material-dispersed resin carrier core material in a magnetic carrier, the structure of the magnetic carrier core material, resulting from stripping of the resin coating layer in the measurement of the content of the resin coating layer described below, is identified using a time-of-flight secondary ion mass spectrometer (FIB-TOF-SIMS). The content of the primer compound is calculated next by measuring the total nitrogen amount in the magnetic carrier core material surface, according to JIS K 0102 45.1.

(Measurement of the Content of Resin Coating Layer in the Magnetic Carrier)

A 100 ml beaker is weighed (measured value 1); thereafter, about 5 g of the sample to be measured (magnetic carrier) are placed in the beaker, and the total mass of the sample and the beaker is accurately weighed (measured value 2).

B About 50 ml of toluene are placed in a beaker, with shaking for 5 minutes using an ultrasonic shaker.

C Once shaking is over, the beaker is left to stand for several minutes, and then the sample in the beaker is stirred 20 times with using a neodymium magnet, so as to trace the bottom of the beaker; thereafter, only the toluene solution into which the resin coating film is dissolved is caused to flow as effluent.

D While holding the sample in the beaker from outside using a neodymium magnet, about 50 ml of toluene are placed again in the beaker, and the operations in B and C above are repeated 10 times.

E The operations in B and C are carried out one more time, with the solvent changed herein to chloroform.

F The beaker is placed in a vacuum dryer, the solvent is removed by drying (using a vacuum dryer provided with a solvent trap, at a temperature of 50° C., degree of vacuum −0.093 MPa or less, drying time 12 hours).

G The beaker is retrieved from the vacuum dryer, is left to stand for about 20 minutes to cool down, and the mass of the beaker is accurately weighed thereafter (measured value 3).

H The resin coating amount (mass %) is calculated on the basis of the measured values thus obtained, in accordance with the expression below.

Resin coating amount=(initial sample weight−sample weight after stripping of coating film)/sample weight×100

In the expression above, the sample weight is worked out through calculation of (measured value 2-measured value 1), and the sample weight after stripping of the coating film is worked out through calculation of (measured value 3-measured value 1).

(Measurement of the Thickness of the Resin Coating Layer)

The method for measuring the thickness of the resin coating layer involved obtaining a cross-section of the magnetic carrier under a transmission electronic microscope (TEM) (50,000 magnifications each), and measuring the thickness of the coating layer.

Specifically, the magnetic carrier was ion-milled using an argon ion milling device (trade name: E-3500, by Hitachi High-Technologies Corporation) and the resin coating layer thickness of the magnetic carrier cross-section was measured at 10 arbitrary points, using the transmission electronic microscope (TEM) (50,000 magnifications each). The same measurement was performed for 100 magnetic carriers, and the minimum value and the maximum value from among the obtained 1000 measured values of resin coating layer thickness were selected as the minimum thickness (μm) and the maximum thickness (μm). The ion milling measurement conditions were as follows.

Beam diameter: 400 μm (half width)

Ion gun acceleration voltage: 5 kV

Ion gun discharge voltage: 4 kV

Ion gun discharge current: 463 ρA

Ion gun irradiation current: 90 ρA/cm$^3$/1 min (Measurement of the Content of Primer Compound in the Resin Coating Layer)

The resin component in the resin coating layer stripped in the measurement of the content of the resin coating layer was identified by FIB-TOF-SIMS. In a case where the resin component has no nitrogen, the content of the primer compound in the stripped resin coating layer is calculated according to JIS K 0102 45.1.

(Measurement of Resistivity (Ω·cm) at an Electric Field Strength of 2000 V/cm)

Resistivity at an electric field strength of 2000 V/cm is measured using the measuring device illustrated schematically in FIG. 5.

A resistance measurement cell A is configured out of a cylindrical container (made of a PTFE resin) 17 having opened therein a hole of 2.4 cm$^2$ of cross-sectional area, a lower electrode (made of stainless steel) 18, a support pedestal (made of a PTFE resin) 19, and an upper electrode (made of stainless steel) 20. The cylindrical container 17 is placed on the support pedestal 19, a sample (magnetic carrier or carrier core) 21 is filled into the container to a thickness of about 1 mm, the upper electrode 20 is placed on the filled sample 21, and the thickness of the sample is measured. The thickness d of the sample is calculated in accordance with the expression below, where d1 is the gap in the absence of sample, as illustrated in FIG. 5A, and d2 is the gap upon filling with sample to a thickness of about 1 mm, as illustrated in FIG. 5B.

$$d=d2-d1 \text{ (mm)}$$

The mass of the sample is modified as appropriate so that the thickness d of the sample lies in the range of 0.95 mm to 1.04 mm.

The resistivity of the sample can then be worked out through measurement of the current that flows upon application of DC voltage across the electrodes. For the measurement there are used an electrometer 22 (Keithley 6517A, by Keithley Instruments, Inc.) and a processing computer 23 for control.

A control system by National Instruments Corporation and control software (LabVIEW by National Instruments Corporation) were used in the processing computer for control.

As the measurement conditions there are input the contact surface area S between the sample and the electrode is S=2.4 cm$^2$, and the actually measured value of d such that the sample thickness lies in the range of 0.95 mm to 1.04 mm. The load of the upper electrode is set to 270 g.

Resistivity(Ω·cm)=(applied voltage(*V*)/measured current(*A*))×*S*(cm$^2$)/*d*(cm)

Electric field strength(*V*/cm)=applied voltage(*V*)/*d*(cm)

The resistivity of the magnetic carrier and the carrier core at the above electric field strength is read off a graph in which the above electric field strengths are plotted. The measured value immediately before the occurrence of breakdown in the obtained graph is taken herein as the breakdown point.

EXAMPLES

The present invention will be explained more specifically with reference to working examples, but the present invention is not limited to just these examples.

Production Example of Coating Resin A

The starting materials given in Table 1 were added to a 4-necked flask provided with a reflux condenser, a thermometer, a nitrogen suction pipe and a ground joint-type stirring device. There were further added 100 parts by mass of toluene, 100 parts by mass of methyl ethyl ketone and 2.4 parts by mass of azobisisovaleronitrile. The whole was then held for 10 hours at a temperature of 80° C., under a nitrogen stream, to yield a solution of coating resin A-1 (solids 35 mass %).

Coating resins A-2 to A-13 were similarly obtained using the starting materials given in Table 1.

A polyester resin (made up of 70 mol % of bisphenol A, 20 mol % of terephthalic acid, 10 mol % of trimellitic acid anhydride, glass transition temperature 70° C.) was used in coating resin A-14, and a silicone resin (TSR102 by Tanac Co., Ltd.) was used in coating resin A-15. Physical properties are given in Table 1.

Production Example of Coating Resin B

The starting materials given in Table 2 were added to a 4-necked flask provided with a reflux condenser, a thermometer, a nitrogen suction pipe and a ground joint-type stirring device. There were further added 50 parts by mass of toluene, 100 parts by mass of methyl ethyl ketone and 2.4 parts by mass of azobisisovaleronitrile. The whole was then held for 10 hours at a temperature of 80° C., under a nitrogen stream, to yield a solution of coating resin B-1 (solids 40 mass %).

Coating resins B-2 to B-5 were obtained similarly using the starting materials given in Table 2. Physical properties are given in Table 2.

Production Examples of Coating Resin Solutions 1 to 33

The coating resin A and coating resin B given in Table 1 and Table 2 were mixed at the parts by mass given in Table 3. Next, 900 parts by mass of toluene were charged for 100 parts by mass of the total amount of resin component, and the whole was mixed until thorough dissolution of the resin component, to prepare thus coating resin solutions 1 to 33.

(Preparation of Magnetic Material Particles A-1)

Herein $Fe_2O_3$ was mixed and crushed for 10 hours in a wet-type ball mill. Then 1 part by mass of polyvinyl alcohol was added, and granulation and drying were carried out in a spray dryer. This was followed by firing for 10 hours at 900° C., in a nitrogen atmosphere with oxygen concentration brought to 0.0 vol %, in an electric furnace.

The obtained magnetic material was crushed for 5 hours in a dry-type ball mill. The magnetic material was sorted in an air classifier (ELBOW JET LABO EJ-L3, by Nittetsu Mining Co., Ltd.), and the obtained fine powder and coarse powder were sorted and removed simultaneously, to yield magnetic material particles A-1 having a number-average particle size of 1.65 μm.

The obtained magnetic material particles A-1 and a silane coupling agent (3-(2-aminoethylamino)propyltrimethoxysilane) (0.2 parts by mass with respect to 100 parts by mass of magnetite microparticles) were introduced into a container. In the container the magnetic material particles A-1 were surface-treated through high-speed mixing and stirring for 1 hour at 100° C.

(Preparation of Magnetic Material Particles B-1)

In a reaction vessel having a gas inlet tube, 26.7 L of an aqueous solution of ferrous sulfate containing 1.5 mol/L of $Fe^{2+}$ and 1.0 L of an aqueous solution of silicate of soda #3 containing 0.2 mol/L of $Si^{4+}$ were added to 22.3 L of a 3.4N aqueous solution of sodium hydroxide, while causing nitrogen gas to flow at a rate of 20 L/minute, to bring the pH to 6.8, with warming up to 90° C. There were further added 1.2 L of a 3.5N aqueous solution of sodium hydroxide, to adjust the pH to 8.5. Stirring was continued and the gas was replaced with air that was caused to flow for 90 minutes at a rate of 100 L/minute. The solution was neutralized to pH 7 using dilute sulfuric acid, and the generated particles were washed with water, filtered, dried and crushed, to yield magnetic material particles B-1 having a number-average particle size of 0.30 lam.

The obtained magnetic material particles B-1 and a silane coupling agent (3-glycidoxypropylmethyldimethoxysilane) (1.2 parts by mass with respect to 100 parts by mass of magnetite microparticles) were introduced into a container. In the container the magnetic material particles B-1 were surface-treated through high-speed mixing and stirring for 1 hour at 100° C.

(Preparation of Non-Magnetic Iron Oxide Particles C-1)

Herein 1.2 parts by mass of a silane coupling agent (3-glycidoxypropylmethyldimethoxysilane) with respect to 100 parts by mass of spherical hematite particles having a number-average particle size of 0.40 lam were surface-treated in the same way as the magnetic material particles B-1.

Production Example of Core Material Particles 1

| | |
|---|---|
| Phenol | 10.0 parts by mass |
| Formaldehyde solution (37 mass % aqueous solution of formaldehyde) | 15.0 parts by mass |
| Surface-treated magnetic material particles A-1 | 30.0 parts by mass |
| Surface-treated magnetic material particles B-1 | 70.0 parts by mass |
| 25 mass % aqueous ammonia | 3.5 parts by mass |
| Water | 15.0 parts by mass |

The above materials were introduced into a reaction vessel and were mixed at a temperature of 40° C. Thereafter, the whole was heated at an average rate of temperature rise of 1.5° C./minute, under stirring, up to a temperature of 85° C. The polymerization reaction was left to proceed for 3 hours, with the temperature held at 85° C., to elicit curing. The peripheral speed of the stirring blade was set to 1.96 m/second.

After the polymerization reaction, the whole was cooled down to a temperature of 30° C., and water was added. The supernatant was removed and the obtained precipitate was washed with water and was air-dried. The obtained air-dried product was dried for 5 hours at 180° C., under reduced pressure (5 mmHg or less), to yield magnetic core material particles 1 (hereafter, core material particles 1) being magnetic material-dispersed resin particles.

Production Example of Core Material Particles 2

Core material particles 2 were obtained in the same way as in the production example of core material particles 1, but herein the surface-treated magnetic material particles A-1 of the production example of the core material particles 1 were not used, being changed instead to 100.0 parts by mass of surface-treated magnetic material particles B-1.

Production Example of Core Material Particles 3

Core material particles 3 were obtained in the same way as in the production example of core material particles 2, but herein the phenol in the production example of the core material particles 2 was changed to 10.0 parts by mass of an epoxy resin (EPICLON HP-6000, by DIC Corporation).

Production Example of Core Material Particles 4

Herein 10.0 parts by mass of a polyester resin ("Tuftone" TTR-2, by Kao Corporation, glass transition point 65° C., acid value 3 mgKOH/g) and 100.0 parts by mass of surface-treated magnetic material particles B-1 were stirred and mixed using a stirrer ("Supermixer" SMV-20, by Kawata MFG Co., Ltd.), followed by melt-kneading in a biaxial kneading extruder (PCM-30, by Ikegai Ironworks Corp). After cooling, the kneaded product was coarsely ground to a 2 mm (I) pass using a coarse crusher (UG-210KGS, by Horai Co, Ltd.). The resulting product was ground in an intermediate crusher ("Fine Mill" FM-300N by Nippon Pneumatic Mfg. Co., Ltd.), and was treated thereafter in a fine powder classifier ("Separator" DS-5UR, by Nippon Pneumatic Mfg. Co., Ltd.), to yield core material particles 4.

Production Example of Core Material Particles 5

Core material particles 5 were produced in the same way as in the production example of core material particles 2, but herein the phenol in the production example of the core material particles 2 was changed to 10.0 parts by mass of a melamine resin obtained through polycondensation of melamine and formaldehyde.

Production Example of Core Material Particles 6

| | |
|---|---|
| Phenol | 10 parts by mass |
| Formaldehyde solution (formaldehyde 40%, methanol 10%, water 50%) | 15 parts by mass |
| Surface-treated magnetic material particles B-1 | 63 parts by mass |
| Surface-treated magnetic material particles C-1 | 21 parts by mass |
| 25 mass % aqueous ammonia | 3.5 parts by mass |
| Water | 15.0 parts by mass |

The above materials were introduced into a reaction vessel and were mixed at a temperature of 40° C. Thereafter, the whole was heated at an average rate of temperature rise of 1.5° C./minute, under stirring, up to a temperature of 85° C. The polymerization reaction was left to proceed for 3 hours, with the temperature held at 85° C., to elicit curing. The peripheral speed of the stirring blade was set to 1.96 m/second.

After the polymerization reaction, the whole was cooled down to a temperature of 30° C., and water was added. The supernatant was removed and the obtained precipitate was washed with water and was air-dried. The obtained air-dried product was dried for 5 hours at 180° C., under reduced pressure (5 mmHg or less), to yield magnetic core material particles 6 (hereafter, core material particles 6) being magnetic material-dispersed resin particles.

Production Example of Carrier Core Materials 1 to 33

Magnetic carrier core materials 1 to 33 (hereafter, carrier core materials 1 to 33) were produced by forming a primer layer using the primer compounds given in Table 4, in the parts by mass given in Table 4 with respect to 100 parts by mass of the core material particles set out in Table 4. Physical properties are given in Table 4.

To form the primer layer, 100 parts by mass of core material particles were charged into a planetary-type mixer (Nauta Mixer VN, by Hosokawa Micron Corporation), then stirring was performed while causing the screw-like stirring blade to revolve at 3.5 revolutions per minute and to rotate at 100 rotations per minute, and nitrogen was adjusted so as to flow at a flow rate of 0.1 $m^3$/min, under reduced pressure (75 mmHg). The whole was heated up to a temperature of 70° C., after which there was charged the primer compound diluted 10 times in toluene. The coating operation was performed for 20 minutes, and thereafter the obtained product was transferred to a mixer (a drum mixer UD-AT Model, by Sugiyama Heavy Industrial Co., Ltd) having a spiral blade within a rotatable mixing container), and a thermal treatment was performed for 2 hours at a temperature of 150° C. in a nitrogen atmosphere, under stirring by causing the mixing container to rotate at 10 revolutions per minute.

Production Examples of Magnetic Carriers 1 to 33

Magnetic carrier core material 1 (100.0 parts by mass) and coating resin solution 1 diluted in toluene so as to yield a solids ratio of 10% were charged into a planetary-type mixer (Nauta Mixer VN, by Hosokawa Micron Corporation) held at a temperature of 60° C. under reduced pressure (1.5 kPa) in such a manner that the content of resin coating layer with respect to 100 parts by mass of the carrier core material was the "Total amount of resin component" in Table 3. In magnetic carriers 4 to 7, 19 to 22, 24, 32 and 33, the primer compound was charged at the same time as the coating resin solution, such that the content of primer compound in the resin coating layer took on the mass % values given in Table 5.

The charging scheme involved charging first half of the amount of resin solution for the magnetic carrier core material, with a 30-minute solvent removal and coating operation, followed next by charging of the other half of the amount of the resin solution, with a 30-minute solvent removal and coating operation.

Thereafter, the magnetic carrier having been coated with the coat resin composition was transferred to a mixer (a drum mixer UD-AT Model, by Sugiyama Heavy Industrial Co., Ltd) having a spiral blade within a rotatable mixing container, and a thermal treatment was performed for 2 hours at a temperature of 120° C. in a nitrogen atmosphere, under stirring by causing the mixing container to rotate at 10 revolutions per minute. A low magnetic product in the obtained magnetic carrier was separated by magnetic concentration, and the carrier was passed through a sieve having 150 μm openings, and was thereafter sorted in an air classifier, to yield magnetic carrier 1.

Magnetic carriers 2 to 33 were obtained in the same way as magnetic carrier 1, using coating resin solutions 2 to 33 for carrier core materials 2 to 33 in such a manner that the content of each resin coating layer with respect to 100 parts by mass of the respective carrier core material was the "Total amount of resin component" in Table 3. The physical property values of the obtained magnetic carriers 1 to 33 are given in Table 5.

TABLE 1

| | Main chain monomer | | Macromonomer | | | | |
|---|---|---|---|---|---|---|---|
| Resin No. | Constituent monomer | Addition amount (mass %) | Constituent monomer | Mw | Addition amount (mass %) | Mw | Acid value (mgKOH/g) |
| A-1 | Cyclohexyl methacrylate | 74.5 | Methyl methacrylate | 5000 | 25.0 | 54,000 | 0.5 |
| | Methyl methacrylate | 0.5 | | | | | |
| A-2 | Cyclohexyl methacrylate | 80.0 | Methyl methacrylate | 5000 | 20.0 | 48,000 | 0.2 |
| A-3 | Dicyclopentanyl acrylate | 60.0 | Methyl methacrylate | 5000 | 20.0 | 79,000 | 1.0 |
| | Methyl methacrylate | 19.8 | | | | | |
| | Methacrylic acid | 0.2 | | | | | |
| A-4 | Cyclohexyl methacrylate | 74.4 | Styrene | 5000 | 20.0 | 45,000 | 2.5 |
| | Methyl methacrylate | 5.0 | | | | | |
| | Methacrylic acid | 0.6 | | | | | |

TABLE 1-continued

| Resin No. | Main chain monomer: Constituent monomer | Main chain monomer: Addition amount (mass %) | Macromonomer: Constituent monomer | Macromonomer: Mw | Macromonomer: Addition amount (mass %) | Mw | Acid value (mgKOH/g) |
|---|---|---|---|---|---|---|---|
| A-5 | Cyclohexyl methacrylate | 75.0 | Styrene | 5000 | 20.0 | 53,000 | 0.5 |
| | Methyl methacrylate | 5.0 | | | | | |
| A-6 | Cyclohexyl methacrylate | 75.0 | Acrylonitrile | 5000 | 20.0 | 55,000 | 0.5 |
| | Methyl methacrylate | 5.0 | | | | | |
| A-7 | Cyclohexyl methacrylate | 80.0 | — | — | — | 55,000 | 1.5 |
| | Methyl methacrylate | 19.7 | | | | | |
| | Methacrylic acid | 0.3 | | | | | |
| A-8 | Dicyclopentanyl acrylate | 20.0 | 2-ethylhexyl methacrylate | 3000 | 15.0 | 67,000 | 2.7 |
| | Cyclohexyl methacrylate | 60.0 | | | | | |
| | Methyl methacrylate | 4.4 | | | | | |
| | Methacrylic acid | 0.6 | | | | | |
| A-9 | Dicyclopentanyl acrylate | 15.0 | 2-ethylhexyl methacrylate | 3000 | 20.0 | 70,000 | 0.1 |
| | Cyclohexyl methacrylate | 60.0 | | | | | |
| | Methyl methacrylate | 5.0 | | | | | |
| A-10 | Dicyclopentanyl acrylate | 20.0 | Butyl methacrylate | 4000 | 10.0 | 96,000 | 3.5 |
| | Cyclohexyl methacrylate | 60.0 | | | | | |
| | Methyl methacrylate | 9.2 | | | | | |
| | Methacrylic acid | 0.8 | | | | | |
| A-11 | Methyl methacrylate | 95.0 | — | — | — | 55,000 | 1.0 |
| | Tert-butyl methacrylate | 4.8 | | | | | |
| | Methacrylic acid | 0.2 | | | | | |
| A-12 | Methyl methacrylate | 70.0 | — | — | — | 55,000 | 0.1 |
| | Styrene | 20.0 | | | | | |
| | 2-hydroxyethyl methacrylate | 10.0 | | | | | |
| A-13 | 2-(perfluorooctyl)-ethyl methacrylate | 60.0 | — | — | — | 65,000 | 0.1 |
| | Methyl methacrylate | 40.0 | | | | | |
| A-14 | Polyester resin | | | | | 75,000 | 20.5 |
| A-15 | Straight silicone resin | | | | | | |

TABLE 2

| Resin No. | Monomer: Constituent monomer | Monomer: Addition amount (mass %) | Mw | Acid value (mgKOH/g) |
|---|---|---|---|---|
| B-1 | Methyl methacrylate | 80.0 | 38,000 | 6.2 |
| | Iso-butyl methacrylate | 18.6 | | |
| | Methacrylic acid | 1.4 | | |
| B-2 | Methyl methacrylate | 79.9 | 36,000 | 4.0 |
| | Iso-butyl methacrylate | 19.2 | | |
| | Methacrylic acid | 0.9 | | |
| B-3 | Methyl methacrylate | 71.0 | 38,000 | 45.0 |
| | Iso-butyl methacrylate | 20.0 | | |
| | Acrylic acid | 9.0 | | |

TABLE 2-continued

| Resin No. | Monomer: Constituent monomer | Monomer: Addition amount (mass %) | Mw | Acid value (mgKOH/g) |
|---|---|---|---|---|
| B-4 | Methyl methacrylate | 80.0 | 85,000 | 3.0 |
| | Iso-butyl methacrylate | 19.6 | | |
| | Acrylic acid | 0.4 | | |
| B-5 | Methyl methacrylate | 70.0 | 30,000 | 55.0 |
| | Iso-butyl methacrylate | 20.0 | | |
| | Acrylic acid | 10.0 | | |

TABLE 3

| Coating resin solution No. | Resin A: No. | Resin A: Addition amount (mass parts) | Resin B: No. | Resin B: Addition amount (mass parts) | Peak area ratio of Resin A (%) | Total amount of resin component (mass parts) | Acid value of resin coating layer |
|---|---|---|---|---|---|---|---|
| 1 | A-1 | 1.50 | B-1 | 0.50 | 75 | 2.0 | 0.5 |
| 2 | A-2 | 1.20 | B-1 | 0.50 | 71 | 1.7 | 0.1 |
| 3 | A-2 | 2.0 | — | — | — | 2.0 | 1.6 |
| 4 | A-2 | 3.0 | — | — | — | 3.0 | 4.2 |
| 5 | A-1 | 1.00 | B-1 | 0.50 | 67 | 1.5 | 3.4 |
| 6 | A-3 | 1.20 | B-2 | 0.30 | 80 | 1.5 | 3.4 |
| 7 | A-1 | 0.50 | B-3 | 0.30 | 63 | 0.8 | 22.8 |
| 8 | A-1 | 3.60 | B-1 | 0.90 | 80 | 4.5 | 5.1 |
| 9 | A-4 | 1.00 | B-2 | 0.50 | 67 | 1.5 | 3.3 |
| 10 | A-5 | 1.5 | — | — | — | 1.5 | 0.5 |
| 11 | A-5 | 1.5 | — | — | — | 1.5 | 0.5 |
| 12 | A-6 | 1.5 | — | — | — | 1.5 | 0.5 |
| 13 | A-7 | 2.0 | — | — | — | 2.0 | 1.5 |
| 14 | A-7 | 1.50 | B-3 | 0.50 | 75 | 2.0 | 12.4 |
| 15 | A-8 | 0.50 | B-4 | 1.50 | 25 | 2.0 | 2.9 |

TABLE 3-continued

| Coating resin solution No. | Resin A No. | Resin A Addition amount (mass parts) | Resin B No. | Resin B Addition amount (mass parts) | Peak area ratio of Resin A (%) | Total amount of resin component (mass parts) | Acid value of resin coating layer |
|---|---|---|---|---|---|---|---|
| 16 | A-9 | 1.20 | B-5 | 0.30 | 80 | 1.5 | 11.1 |
| 17 | A-10 | 0.75 | B-2 | 0.75 | 50 | 1.5 | 3.8 |
| 18 | A-7 | 1.20 | B-3 | 0.30 | 80 | 1.5 | 10.2 |
| 19 | A-7 | 1.5 | | — | — | 1.5 | 1.5 |
| 20 | A-7 | 0.30 | B-2 | 0.30 | 50 | 0.6 | 2.8 |
| 21 | A-7 | 3.60 | B-5 | 1.20 | 75 | 4.8 | 14.9 |
| 22 | A-7 | 0.30 | B-5 | 0.30 | 50 | 0.6 | 28.3 |
| 23 | A-2 | 0.75 | B-1 | 0.75 | 50 | 1.5 | 0.0 |
| 24 | A-2 | 0.75 | B-1 | 0.75 | 50 | 1.5 | 0.0 |
| 25 | A-2 | 0.4 | — | — | — | 0.4 | 0.1 |
| 26 | A-2 | 5.5 | — | — | — | 5.5 | 0.1 |
| 27 | A-11 | 1.5 | — | — | — | 1.5 | 1.0 |
| 28 | A-12 | 1.5 | — | — | — | 1.5 | 0.1 |
| 29 | A-13 | 1.5 | — | — | — | 1.5 | 0.1 |
| 30 | A-14 | 1.5 | — | — | — | 1.5 | 20.5 |
| 31 | A-15 | 0.6 | — | — | — | 0.6 | — |
| 32 | A-15 | 5.0 | — | — | — | 5.0 | — |
| 33 | A-11 | 5.0 | — | — | — | 5.0 | — |

TABLE 4

| Carrier core material No. | Core material particles No. | Resin component of core material particles | Primer compound | Primer addition amount | Volume average particle size (μm) | Magnetization amount ($Am^2/kg$) |
|---|---|---|---|---|---|---|
| 1 | 1 | Phenol | 3-aminopropyltrimethoxysilane | 0.40 | 36.5 | 59 |
| 2 | 2 | Phenol | 3-aminopropyldiethoxymethylsilane | 0.40 | 34.5 | 58 |
| 3 | 2 | Phenol | 3-(2-aminoethylamino)propyltrimethoxysilane | 0.50 | 34.6 | 58 |
| 4 | 2 | Phenol | 3-(2-aminoethylamino)propyldimethoxymethylsilane | 0.50 | 34.7 | 58 |
| 5 | 1 | Phenol | 3-aminopropyldimethoxymethylsilane | 0.40 | 36.5 | 58 |
| 6 | 1 | Phenol | 3-aminopropyltriethoxysilane | 0.50 | 36.8 | 58 |
| 7 | 2 | Phenol | 3-aminopropyltriethoxysilane | 0.55 | 34.8 | 58 |
| 8 | 1 | Phenol | Trimethoxy[3-(phenylamino)propyl]silane | 0.40 | 36.5 | 58 |
| 9 | 6 | Phenol | Trimethoxy[3-(methylamino)propyl]silane | 0.15 | 36.0 | 43 |
| 10 | 2 | Phenol | 3-aminopropyltriethoxysilane | 0.65 | 35.0 | 57 |
| 11 | 2 | Phenol | 3-aminopropyltriethoxysilane | 0.75 | 35.3 | 57 |
| 12 | 2 | Phenol | 3-aminopropyltriethoxysilane | 0.83 | 35.5 | 57 |
| 13 | 2 | Phenol | 3-(2-aminoethylamino)propyltriethoxysilane | 0.40 | 34.4 | 58 |
| 14 | 2 | Phenol | 3-aminopropyltriethoxysilane | 0.40 | 34.5 | 58 |
| 15 | 2 | Phenol | 3-aminopropyldimethoxymethylsilane | 0.40 | 34.5 | 58 |
| 16 | 3 | Epoxy | 3-aminopropyltrimethoxysilane | 0.40 | 44.5 | 58 |
| 17 | 4 | PES | 3-aminopropyltriethoxysilane | 0.40 | 40.5 | 58 |
| 18 | 4 | PES | [3-(N,N-dimethylamino)propyl]trimethoxysilane | 0.12 | 40.1 | 59 |
| 19 | 4 | PES | 3-aminopropyltriethoxysilane | 0.88 | 40.8 | 57 |
| 20 | 4 | PES | 3-(2-aminoethylamino)propyltriethoxysilane | 0.12 | 40.0 | 59 |
| 21 | 4 | PES | [3-(N,N-dimethylamino)propyl]trimethoxysilane | 0.88 | 40.8 | 57 |
| 22 | 5 | Melamine | 3-(2-aminoethylamino)propyltriethoxysilane | 0.12 | 48.5 | 58 |
| 23 | 1 | Phenol | 3-aminopropyltriethoxysilane | 0.08 | 35.8 | 59 |
| 24 | 1 | Phenol | 3-aminopropyltriethoxysilane | 1.00 | 37.2 | 57 |
| 25 | 1 | Phenol | 3-aminopropyltrimethoxysilane | 0.12 | 36.0 | 58 |
| 26 | 1 | Phenol | 3-aminopropyltriethoxysilane | 0.88 | 37.0 | 57 |
| 27 | 1 | Phenol | 3-aminopropyltriethoxysilane | 0.12 | 36.0 | 58 |
| 28 | 1 | Phenol | 3-aminopropyltrimethoxysilane | 0.10 | 35.9 | 59 |
| 29 | 1 | Phenol | 3-aminopropyldiethoxymethylsilane | 0.88 | 37.1 | 57 |
| 30 | 1 | Phenol | 3-(2-aminoethylamino)propyltrimethoxysilane | 0.88 | 37.0 | 57 |
| 31 | 1 | Phenol | 3-(2-aminoethylamino)propyldimethoxymethylsilane | 0.88 | 36.9 | 57 |
| 32 | 1 | Phenol | 3-aminopropyltrimethoxysilane | 0.90 | 37.1 | 57 |
| 33 | 1 | Phenol | 3-Glycidyloxypropyltrimethoxysilane | 0.90 | 37.3 | 57 |

TABLE 5

| Magnetic carrier No. | Magnetic carrier core material No. | Resin coating layer No. | Primer agent amount in resin coating layer (mass %) | Resistivity (Ω · cm) | Resin coating layer Minimum thickness (μm) | Resin coating layer Maximum thickness (μm) |
|---|---|---|---|---|---|---|
| 1 | 1 | 1 | — | $7.9 \times 10^9$ | 2.750 | 3.280 |
| 2 | 2 | 2 | — | $2.4 \times 10^9$ | 2.150 | 3.195 |
| 3 | 3 | 3 | — | $4.0 \times 10^9$ | 2.290 | 3.410 |

TABLE 5-continued

| Magnetic carrier No. | Magnetic carrier core material No. | Resin coating layer No. | Primer agent amount in resin coating layer (mass %) | Resistivity (Ω · cm) | Resin coating layer Minimum thickness (μm) | Resin coating layer Maximum thickness (μm) |
|---|---|---|---|---|---|---|
| 4 | 4 | 4 | 0.2 | $8.0 \times 10^9$ | 2.555 | 3.710 |
| 5 | 5 | 5 | 1.0 | $8.3 \times 10^9$ | 2.810 | 3.335 |
| 6 | 6 | 6 | 4.0 | $9.0 \times 10^9$ | 2.790 | 3.410 |
| 7 | 7 | 7 | 2.0 | $2.8 \times 10^9$ | 0.005 | 0.012 |
| 8 | 8 | 8 | — | $2.3 \times 10^{10}$ | 3.520 | 4.100 |
| 9 | 9 | 9 | — | $5.6 \times 10^{10}$ | 1.955 | 2.270 |
| 10 | 10 | 10 | — | $3.6 \times 10^9$ | 1.895 | 2.315 |
| 11 | 11 | 11 | — | $3.4 \times 10^9$ | 1.975 | 2.265 |
| 12 | 12 | 12 | — | $3.5 \times 10^9$ | 1.885 | 2.240 |
| 13 | 13 | 13 | — | $2.3 \times 10^9$ | 2.295 | 2.480 |
| 14 | 14 | 14 | — | $2.4 \times 10^9$ | 2.200 | 2.405 |
| 15 | 15 | 15 | — | $2.4 \times 10^9$ | 2.153 | 2.415 |
| 16 | 16 | 16 | — | $2.6 \times 10^8$ | 2.315 | 2.640 |
| 17 | 17 | 17 | — | $7.6 \times 10^8$ | 2.260 | 2.630 |
| 18 | 18 | 18 | — | $6.6 \times 10^8$ | 2.355 | 2.710 |
| 19 | 19 | 19 | 3.7 | $9.5 \times 10^8$ | 2.540 | 2.840 |
| 20 | 20 | 20 | 3.8 | $5.3 \times 10^8$ | 0.015 | 0.025 |
| 21 | 21 | 21 | 4.0 | $9.2 \times 10^9$ | 3.820 | 4.100 |
| 22 | 22 | 22 | 4.0 | $5.3 \times 10^8$ | 0.015 | 0.030 |
| 23 | 23 | 23 | — | $4.1 \times 10^9$ | 2.310 | 2.650 |
| 24 | 24 | 24 | 4.0 | $1.2 \times 10^{10}$ | 2.315 | 2.550 |
| 25 | 25 | 25 | — | $1.3 \times 10^9$ | 0.005 | 0.025 |
| 26 | 26 | 26 | — | $8.9 \times 10^{10}$ | 4.020 | 4.325 |
| 27 | 27 | 27 | — | $5.1 \times 10^9$ | 2.340 | 2.940 |
| 28 | 28 | 28 | — | $4.9 \times 10^9$ | 2.240 | 3.055 |
| 29 | 29 | 29 | — | $9.3 \times 10^9$ | 2.135 | 3.080 |
| 30 | 30 | 30 | — | $9.7 \times 10^9$ | 2.540 | 2.840 |
| 31 | 31 | 31 | — | $9.5 \times 10^9$ | 0.015 | 0.035 |
| 32 | 32 | 32 | 5.0 | $7.6 \times 10^{10}$ | 3.805 | 4.150 |
| 33 | 33 | 33 | 5.0 | $2.7 \times 10^{11}$ | 3.705 | 4.235 |

Production Example of Cyan Toner 1

| | |
|---|---|
| Binder resin (polyester having Tg 58° C., acid value 15 mgKOH/g, hydroxyl value 15 mgKOH/g) | 100 parts by mass |
| C.I. Pigment Blue 15:3 | 5.5 parts by mass |
| Aluminum 3,5-di-t-butyl salicylate compound | 0.5 parts by mass |
| Normal paraffin wax (melting point: 78° C.) | 6 parts by mass |

The materials in the above formulation were mixed thoroughly in a Henschel mixer (FM-75J model, by NIPPON COKE & ENGINEERING. CO., LTD.); thereafter, the resulting mixture was kneaded (temperature of the ejected kneaded product 150° C.) at a feed amount of 10 kg/hr using a biaxial kneader (trade name: PCM-30 model, by Ikegai Ironworks Corp) set to at a temperature of 130° C. The obtained kneaded product was cooled and was coarsely crushed in a hammer mill; thereafter, the product was pulverized to a fine powder, at a feed amount of 15 kg/hr, in a mechanical crusher (trade name: T-250, by Turbo Kogyo Co., Ltd.). There were obtained particles having a weight-average particle size of 5.5 μm and containing 55.6 num % of particles having a particle size of 4.0 μm or smaller and 0.8 vol % of particles having a particle size of 10.0 μm or greater.

The obtained particles were classified through cutting of a fine powder and a coarse powder using a rotary classifier (trade name: TTSP100, by Hosokawa Micron Corporation). There were obtained cyan toner particles 1 having a weight-average particle size of 6.4 μm and abundance of 25.8 num % of particles having a particle size of 4.0 μm or smaller and abundance of 2.5 vol % of particles having a particle size of 10.0 μm or greater.

Further, the materials below were charged into the Henschel mixer (FM-75J model, by NIPPON COKE & ENGINEERING. CO., LTD.), and were mixed over a mixing time of 3 minutes, with the peripheral speed of the rotating blade set to 35.0 (m/second), to cause silica particles and titanium oxide particles to adhere to the surface of the cyan toner particles 1, and yield thereby cyan toner 1.

| | |
|---|---|
| Cyan toner particles 1: | 100 parts by mass |
| Silica particles (silica particles produced in accordance with a sol-gel method and surface-treated with 1.5 mass % of hexamethyldisilazane, followed by adjustment to the desired particle size distribution through sorting): | 3.5 parts by mass |
| Titanium oxide particles (obtained by treating the surface of metatitanic acid having anatase-type crystallinity with an octylsilane compound): | 0.5 parts by mass |

(Synthesis of a Crystalline Polyester Resin)

A reaction vessel equipped with a cooling tube, a stirrer and a nitrogen introduction tube was charged with 1200 parts of 1,6-hexanediol, 1200 parts of decanedioic acid, and 0.4 parts of dibutyltin oxide as a catalyst; thereafter, the air in the vessel was changed into an inert atmosphere of nitrogen gas through a reduced pressure operation, and stirring was performed for 4 hours at 180 rpm by mechanical stirring. Thereafter, the temperature was raised gradually up to 210° C., under reduced pressure, and stirring was performed for 1.5 hours. The reaction was stopped through cooling in air once a viscous state was reached, to yield a crystalline polyester resin.

Production Example of Cyan Toner 2

| | |
|---|---|
| Binder resin (polyester having Tg 58° C., acid value 15 mgKOH/g, hydroxyl value 15 mgKOH/g) | 90 parts by mass |
| The above crystalline polyester resin | 10 parts by mass |
| C.I. Pigment Blue 15:3 | 5.5 parts by mass |
| Aluminum 3,5-di-t-butyl salicylate compound | 0.5 parts by mass |
| Normal paraffin wax (melting point: 78° C.) | 6 parts by mass |

Cyan toner 2 was produced in the same way as in the production example of cyan toner 1 but using herein the materials in the formulation above.

Examples 1 to 5

Herein 10 parts by mass of cyan toner 1 or cyan toner 2 were added to 90 parts by mass of magnetic carrier 1, and the whole was shaken in a shaker (YS-8D, by Yayoi Co., Ltd.), to prepare 300 g of a two-component developer. The shaking conditions of the shaker were set to 200 rpm and 2 minutes.

The evaluations below were performed using this two-component developer.

A modified color copier (trade name: imageRUNNER ADVANCE C9075 PRO, by Canon Inc.) was used as the image forming apparatus.

The two-component developer was charged into the respective color developing devices, a replenishment developer container having been charged with replenishment developer was set, images were formed, and various evaluations were performed.

The environmental evaluation in the copier was performed at temperature 23° C./humidity 50% RH (hereafter, N/N), temperature 23° C./humidity 5% RH (hereafter N/L) and temperature 30° C./humidity 80% RH (hereafter H/H).

The type of output image and number of output prints varied depending on the respective evaluation item.

Conditions:

Paper: Laser printer paper (trade name: CS-814(81.4 g/m$^2$, by Canon Marketing Japan Inc.))

Image formation speed: modified to enable output of 80 sheets of A4 size paper per minute, in full color.

Developing conditions: modified to make developing contrast adjustable to any value, and disable automatic correction by the body of the copier.

A replenishment developer container packed with toner alone was used herein as the replenishment developer.

The evaluation items are given below.

(1) Density Difference (Evaluation V and W) in Vvarious Environments

Evaluation was performed using cyan toner 1.

In "N/N", the developing contrast was adjusted in such a manner that the on-paper solid image reflection density of respective monochromatic colors took on a value of 1.50, and 1000 prints of a cyan solid image were output. Thereafter, the copier body having the developing contrast set for N/N was left to stand as it was for 24 hours in each of N/L and H/H environments, and 10 prints of the cyan solid image were output in each environment.

The reflection density of 5 arbitrary points in the first, fifth and tenth images of the 10 output images was measured, and the average value was worked out. Reflection density was measured herein using a spectrodensitometer series 500 (by X-Rite Inc.).

The absolute value of reflection density difference of H/H with respect to N/N was evaluation V, and the absolute value of reflection density difference of N/L with respect to N/N was evaluation W.

The criteria in evaluations V and W were as follows.

A (10 points): less than 0.06

B (8 points): from 0.06 to less than 0.10

C (6 points): from 0.10 to less than 0.14

D (4 points): from 0.14 to less than 0.18

E (2 points): 0.18 or more (2) Image Spattering (Evaluation X)

Evaluation was performed using cyan toner 1.

Figure 6:
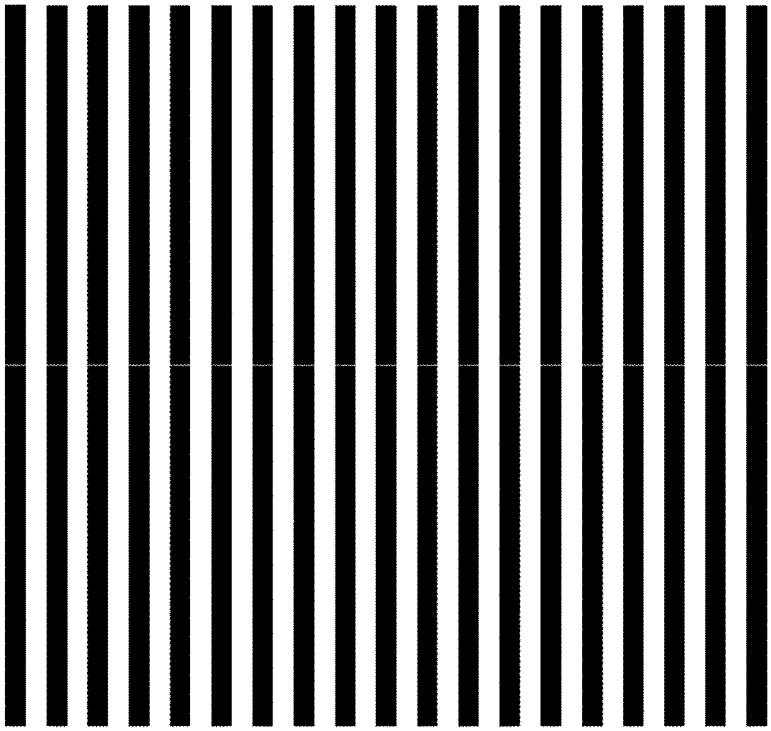
FIG. 6 is an example of an image for spattering evaluation.

After 72 hours of standing in an N/L environment, developing contrast was adjusted so that the on-paper solid-image reflection density was 1.50, and 5000 prints of a cyan solid image were output. Thereafter, 10 prints of the image illustrated in FIG. 6 (19 lines, line width 100 μm, spacing 300 μm, line length 1.0 cm) were output as an unfixed image, and the prints were fixed through standing for 3 minutes in an oven at 100° C.

The lines in the images were observed using a loupe, and there was counted number of spattered specks where toner had adhered other than at line portions. The worst print among the above 10 prints was evaluated.

The criteria in evaluation X were as follows.

A (5 points): Up to 19 specks

B (4 points): from 20 to 29 specks

C (3 points): from 30 to 39 specks

D (2 points): from 40 to 49 specks

E (1 point): from 50 to 59 specks (3) Image Density Difference Before and after Standing (Evaluations Y, Z)

Evaluations were performed using cyan toner 2.

After humidity conditioning for 72 hours in an H/H environment, developing contrast was adjusted so that solid-image reflection density was 1.50, and 5000 prints of a solid image were output. This was followed by standing in that state, and by output of one print of the solid image after 9 days had elapsed. The image density was measured using a spectrodensitometer 500 series (by X-Rite Inc.), and the density difference before and after standing (image density before standing−image density after standing) was evaluated (evaluation Y).

Thereafter, the step of continuously outputting 9 prints of a solid white image and outputting one solid image was repeated. The number of steps required in order to bring the one-print solid-image reflection density to 1.50±0.02 was measured, and the results were evaluated (evaluation Z).

The criteria in evaluation Y were as follows.

A (10 points): less than 0.06

B (8 points): from 0.06 to less than 0.10

C (6 points): from 0.10 to less than 0.14

D (4 points): from 0.14 to less than 0.18

E (2 points): 0.18 or more

The criteria in evaluation Z were as follows.

A (5 points): from 1 to 2 steps

B (4 points): from 3 to 5 steps

C (3 points): from 6 to 8 steps

D (2 points): from 9 to 12 steps

E (1 point): 13 steps or more (4) Comprehensive Rating

The rankings from evaluation V to evaluation Z were assigned numerical values, and the total values were graded in accordance with the criteria below.

A: 38 to 40

B: 31 to 37

C: 26 to 30

D: 20 to 25

E: up to 19

Examples 1 to 5 exhibited very good results in all evaluations. The evaluation results are given in Tables 6 and 7.

In Examples 1 to 22 there were used magnetic carriers 1 to 22, respectively, and in Comparative examples 1 to 11 there were used magnetic carriers 23 to 33, respectively.

Example 6

In Example 6, where the coating layer contains a small amount of an amino group-containing primer compound, environmental stability and image density difference before and after standing are prone to be somewhat affected at elevated charge in N/L. The evaluation results are given in Tables 6 and 7.

Examples 7 and 8

In Example 7, where the thickness of the coating layer is rather small, environmental stability and image density difference before and after standing tend to become somewhat affected at elevated charge in N/L. In Example 8, where the thickness of the coating layer is rather large, the effect of the amino group-containing primer compound is hard to elicit and image density difference before and after standing is prone to be somewhat affected. The evaluation results are given in Tables 6 and 7.

Examples 9 to 12

The amount of primer compound is modified in Examples 9 to 12. Environmental stability is readily affected at reduced charge in H/H when the amount of primer compound is small, and at elevated charge at N/L when the amount of primer compound is large. The image density difference before and after standing is also prone to be somewhat affected. The evaluation results are given in Tables 6 and 7.

Examples 13 to 17

The resin of the coating layer is modified in Examples 13 to 17. The effect of enhancing environmental stability and reducing image density difference before and after standing can be made more prominent through the use of a macromonomer in the resin. In the case of using two types of coating resin, also a density stability effect during endurance is achieved through proper setting of the acid value. The evaluation results are given in Tables 6 and 7.

Example 18

In Example 18 the primer compound is added in a small amount. Environmental stability is readily affected at reduced charge in H/H. The image density difference before and after standing is also readily affected.

The evaluation results are given in Tables 6 and 7.

Example 19

In Example 19 the primer compound is added in a large amount. Environmental stability is readily affected at elevated charge in N/L. The image density difference before and after standing is also readily affected.

The evaluation results are given in Tables 6 and 7.

Example 20

In Example 20, where the coating amount is small, environmental stability and image density difference before and after standing tend to become somewhat affected at elevated charge in N/L. The evaluation results are given in Tables 6 and 7.

Example 21

In Example 21, where the coating amount is large, the effect of the amino group-containing primer compound is hard to elicit, and image density difference before and after standing is readily affected. The evaluation results are given in Tables 6 and 7.

Example 22

In Example 22 a melamine resin is used in the resin component of the core material. Reactivity with the primer compound decreases, and density fluctuation and image spattering are readily affected. The evaluation results are given in Tables 6 and 7.

Comparative Example 1

In Comparative example 1, where the primer treatment amount is excessively small, the effect of the primer compound fails to be achieved, while environmental stability and image density difference before and after standing tend to become poorer. The evaluation results are given in Tables 6 and 7.

Comparative Example 2

In Comparative example 2, where the primer treatment amount is excessively large, environmental stability is impaired due to excessive charge imparting by the primer compound. The image density difference before and after standing as well tends to worsen. The evaluation results are given in Tables 6 and 7.

Comparative Example 3

In Comparative example 3, where the coating amount is excessively small, environmental stability and image density difference before and after standing are readily affected at elevated charge in N/L. The evaluation results are given in Tables 6 and 7.

Comparative Example 4

In Comparative example 4, where the coating amount is large, the effect of the amino group-containing primer compound is hard to elicit, and image density difference before and after standing is impaired. The evaluation results are given in Tables 6 and 7.

Comparative Examples 5 to 10

In Comparative examples 5 to 10, where there are used coating resins having no alicyclic hydrocarbon group, the surface smoothness specific to alicyclic hydrocarbon groups fails to be elicited, and density stability and image spattering are impaired. Environmental stability and image density difference before and after standing as well are impaired. The evaluation results are given in Tables 6 and 7.

Comparative Example 11

In Comparative example 11 there is used a primer compound having no amino group. The effect of the present invention is not elicited, and environmental stability and image density difference before and after standing are likewise impaired. The evaluation results are given in Tables 6 and 7.

TABLE 6

| | Evaluation V (N/N − H/H) | | | 評価 W (N/N − N/L) | | | Evaluation X | | Evaluation Y | | | Evaluation Z | |
|---|---|---|---|---|---|---|---|---|---|---|---|---|---|
| | H/H | | | N/L | | | | | | Difference before and after standing (%) | | Steps (times) required for recovery | |
| | reflection density (%) | Difference with NN (%) | Rat-ing | reflection density (%) | Difference with NN (%) | Rat-ing | Spatter count (specks) | Rating | reflection density (%) | | Rating | | Rating |
| Example 1 | 1.52 | 0.02 | A | 1.47 | 0.03 | A | 13 | A | 1.53 | 0.03 | A | 1 | A |
| Example 2 | 1.53 | 0.03 | A | 1.47 | 0.03 | A | 13 | A | 1.53 | 0.03 | A | 1 | A |
| Example 3 | 1.54 | 0.04 | A | 1.46 | 0.04 | A | 15 | A | 1.54 | 0.04 | A | 1 | A |
| Example 4 | 1.54 | 0.04 | A | 1.46 | 0.04 | A | 16 | A | 1.55 | 0.05 | A | 2 | A |
| Example 5 | 1.54 | 0.04 | A | 1.45 | 0.05 | A | 16 | A | 1.55 | 0.05 | A | 2 | A |
| Example 6 | 1.55 | 0.05 | A | 1.44 | 0.06 | B | 17 | A | 1.56 | 0.06 | B | 2 | A |
| Example 7 | 1.55 | 0.05 | A | 1.44 | 0.06 | B | 17 | A | 1.57 | 0.07 | B | 2 | A |
| Example 8 | 1.55 | 0.05 | A | 1.43 | 0.07 | B | 18 | A | 1.57 | 0.07 | B | 3 | B |
| Example 9 | 1.57 | 0.07 | B | 1.46 | 0.04 | A | 21 | B | 1.57 | 0.07 | B | 3 | B |
| Example 10 | 1.55 | 0.05 | A | 1.43 | 0.07 | B | 22 | B | 1.56 | 0.06 | B | 4 | B |
| Example 11 | 1.55 | 0.05 | A | 1.40 | 0.10 | C | 21 | B | 1.58 | 0.08 | B | 4 | B |
| Example 12 | 1.55 | 0.05 | A | 1.39 | 0.11 | C | 30 | C | 1.58 | 0.08 | B | 5 | B |
| Example 13 | 1.57 | 0.07 | B | 1.43 | 0.07 | B | 31 | C | 1.59 | 0.09 | B | 6 | C |
| Example 14 | 1.58 | 0.08 | B | 1.43 | 0.07 | B | 33 | C | 1.59 | 0.09 | B | 6 | C |
| Example 15 | 1.59 | 0.09 | B | 1.43 | 0.07 | B | 33 | C | 1.61 | 0.11 | C | 6 | C |
| Example 16 | 1.60 | 0.10 | C | 1.43 | 0.07 | B | 35 | C | 1.62 | 0.12 | C | 6 | C |
| Example 17 | 1.61 | 0.11 | C | 1.43 | 0.07 | B | 34 | C | 1.61 | 0.11 | C | 8 | C |
| Example 18 | 1.64 | 0.14 | D | 1.38 | 0.12 | C | 36 | C | 1.62 | 0.12 | C | 7 | C |
| Example 19 | 1.62 | 0.12 | C | 1.36 | 0.14 | D | 36 | C | 1.63 | 0.13 | C | 6 | C |
| Example 20 | 1.64 | 0.14 | D | 1.35 | 0.15 | D | 38 | C | 1.63 | 0.13 | C | 8 | C |
| Example 21 | 1.65 | 0.15 | D | 1.35 | 0.15 | D | 36 | C | 1.63 | 0.13 | C | 8 | C |
| Example 22 | 1.66 | 0.16 | D | 1.35 | 0.15 | D | 38 | C | 1.63 | 0.13 | C | 8 | C |
| Comparative example 1 | 1.67 | 0.17 | D | 1.34 | 0.16 | D | 39 | C | 1.64 | 0.14 | D | 8 | C |
| Comparative example 2 | 1.63 | 0.13 | C | 1.32 | 0.18 | E | 41 | D | 1.65 | 0.15 | D | 8 | C |
| Comparative example 3 | 1.63 | 0.13 | C | 1.31 | 0.19 | E | 42 | D | 1.66 | 0.16 | D | 10 | D |
| Comparative example 4 | 1.65 | 0.15 | D | 1.34 | 0.16 | D | 44 | D | 1.66 | 0.16 | D | 10 | D |
| Comparative example 5 | 1.65 | 0.15 | D | 1.33 | 0.17 | D | 43 | D | 1.67 | 0.17 | D | 11 | D |
| Comparative example 6 | 1.65 | 0.15 | D | 1.33 | 0.17 | D | 45 | D | 1.67 | 0.17 | D | 11 | D |
| Comparative example 7 | 1.66 | 0.16 | D | 1.34 | 0.16 | D | 44 | D | 1.68 | 0.18 | E | 12 | D |
| Comparative example 8 | 1.66 | 0.16 | D | 1.34 | 0.16 | D | 43 | D | 1.69 | 0.19 | E | 13 | E |
| Comparative example 9 | 1.66 | 0.16 | D | 1.34 | 0.16 | D | 46 | D | 1.68 | 0.18 | E | 14 | E |
| Comparative example 10 | 1.66 | 0.16 | D | 1.35 | 0.15 | D | 36 | C | 1.69 | 0.19 | E | 12 | D |
| Comparative example 11 | 1.66 | 0.16 | D | 1.34 | 0.16 | D | 45 | D | 1.70 | 0.20 | E | 15 | E |

TABLE 7

| | Evaluation V | Evaluation W | Evaluation X | Evaluation Y | Evaluation Z | Determination index | Comprehensive evaluation |
|---|---|---|---|---|---|---|---|
| Example 1 | 10 | 10 | 5 | 10 | 5 | 40 | A |
| Example 2 | 10 | 10 | 5 | 10 | 5 | 40 | A |
| Example 3 | 10 | 10 | 5 | 10 | 5 | 40 | A |
| Example 4 | 10 | 10 | 5 | 10 | 5 | 40 | A |
| Example 5 | 10 | 10 | 5 | 10 | 5 | 40 | A |
| Example 6 | 10 | 8 | 5 | 8 | 5 | 36 | B |
| Example 7 | 10 | 8 | 5 | 8 | 5 | 36 | B |
| Example 8 | 10 | 8 | 5 | 8 | 4 | 35 | B |
| Example 9 | 8 | 10 | 4 | 8 | 4 | 34 | B |
| Example 10 | 10 | 8 | 4 | 8 | 4 | 34 | B |
| Example 11 | 10 | 6 | 4 | 8 | 4 | 32 | B |
| Example 12 | 10 | 6 | 3 | 8 | 4 | 31 | B |

TABLE 7-continued

| | Evaluation V | Evaluation W | Evaluation X | Evaluation Y | Evaluation Z | Determination index | Comprehensive evaluation |
|---|---|---|---|---|---|---|---|
| Example 13 | 8 | 8 | 3 | 8 | 3 | 30 | C |
| Example 14 | 8 | 8 | 3 | 8 | 3 | 30 | C |
| Example 15 | 8 | 8 | 3 | 6 | 3 | 28 | C |
| Example 16 | 6 | 8 | 3 | 6 | 3 | 26 | C |
| Example 17 | 6 | 8 | 3 | 6 | 3 | 26 | C |
| Example 18 | 4 | 6 | 3 | 6 | 3 | 22 | D |
| Example 19 | 6 | 4 | 3 | 6 | 3 | 22 | D |
| Example 20 | 4 | 4 | 3 | 6 | 3 | 20 | D |
| Example 21 | 4 | 4 | 3 | 6 | 3 | 20 | D |
| Example 22 | 4 | 4 | 3 | 6 | 3 | 20 | D |
| Comparative example 1 | 4 | 4 | 3 | 4 | 3 | 18 | E |
| Comparative example 2 | 6 | 2 | 2 | 4 | 3 | 17 | E |
| Comparative example 3 | 6 | 2 | 2 | 4 | 2 | 16 | E |
| Comparative example 4 | 4 | 4 | 2 | 4 | 2 | 16 | E |
| Comparative example 5 | 4 | 4 | 2 | 4 | 2 | 16 | E |
| Comparative example 6 | 4 | 4 | 2 | 4 | 2 | 16 | E |
| Comparative example 7 | 4 | 4 | 2 | 2 | 2 | 14 | E |
| Comparative example 8 | 4 | 4 | 2 | 2 | 1 | 13 | E |
| Comparative example 9 | 4 | 4 | 2 | 2 | 1 | 13 | E |
| Comparative example 10 | 4 | 4 | 3 | 2 | 2 | 15 | E |
| Comparative example 11 | 4 | 4 | 2 | 2 | 1 | 13 | E |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-165810, filed Aug. 25, 2015, which is hereby incorporated by reference herein in its entirety.

What is claimed is:

1. A magnetic carrier comprising:

a magnetic material-dispersed resin carrier core material; and a resin coating layer on the surface of the magnetic material-dispersed resin carrier core material, wherein the magnetic material-dispersed resin carrier core material contains a core material particle containing a magnetic material and a binder resin, and a primer compound having an amino group, the resin coating layer contains a coating resin A, which is a polymer of monomers including at least a (meth) acrylic acid ester having an alicyclic hydrocarbon group, the content of the primer compound in the magnetic material-dispersed resin carrier core material is from 0.10 parts by mass to 0.90 parts by mass with respect to 100 parts by mass of the core material particle, and the content of the resin coating layer is from 0.5 parts by mass to 5.0 parts by mass with respect to 100 parts by mass of the magnetic material-dispersed resin carrier core material.

2. The magnetic carrier according to claim 1, wherein the binder resin is a resin selected from the group of phenolic resins, epoxy resins and polyester resins.

3. The magnetic carrier according to claim 1, wherein the coating resin A contains a copolymer of at least a (meth)acrylic acid ester having an alicyclic hydrocarbon group, another (meth)acrylic monomer and a macromonomer, and the macromonomer is a polymer of one, two or more monomers selected from the group of methyl acrylate, methyl methacrylate, butyl acrylate, butyl methacrylate, 2-ethylhexyl acrylate, 2-ethylhexyl methacrylate, styrene, acrylonitrile and methacrylonitrile.

4. The magnetic carrier according to claim 1, wherein the resin coating layer contains:

i) the coating resin A, which is a copolymer of a (meth) acrylic acid ester having an alicyclic hydrocarbon group and another (meth)acrylic monomer, and has an acid value of from 0.0 mgKOH/g to 3.0 mgKOH/g; and ii) a coating resin B, which is a polymer of monomers including at least the other (meth)acrylic monomer, and has an acid value of from 3.5 mgKOH/g to 50.0 mgKOH/g.

5. The magnetic carrier according to claim 1, wherein the resin coating layer contains:

i) the coating resin A, which is a copolymer of monomers including a (meth)acrylic acid ester having an alicyclic hydrocarbon group, another (meth)acrylic monomer and a macromonomer, and has an acid value of from 0.0 mgKOH/g to 3.0 mgKOH/g; and ii) a coating resin B, which is a polymer of monomers including at least the other (meth)acrylic monomer, and has an acid value of from 3.5 mgKOH/g to 50.0 mgKOH/g, and wherein the macromonomer is a polymer of one, two or more monomers selected from the group of methyl acrylate, methyl methacrylate, butyl acrylate, butyl methacrylate, 2-ethylhexyl acrylate, 2-ethylhexyl methacrylate, styrene, acrylonitrile and methacrylonitrile.

6. The magnetic carrier according to claim 1, wherein the content of the primer compound is from 0.10 parts by mass to 0.80 parts by mass with respect to 100 parts by mass of the core material particle.

7. The magnetic carrier according to claim 1, wherein the content of the primer compound is from 0.10 parts by mass to 0.60 parts by mass with respect to 100 parts by mass of the core material particle.

8. The magnetic carrier according to claim 1, wherein the content of the primer compound is from 0.20 parts by mass to 0.80 parts by mass with respect to 100 parts by mass of the core material particle.

9. The magnetic carrier according to claim 1, wherein a minimum thickness of the resin coating layer is from 0.01 μm to 4.00 μm.

10. The magnetic carrier according to claim 1, wherein the resin coating layer contains a primer compound having an amino group, and the content of the primer compound in the resin coating layer is 4.0 mass % or less.

11. A two-component developer comprising:

a toner comprising a toner particle containing a binder resin; and a magnetic carrier, wherein the magnetic carrier comprises a magnetic material-dispersed resin carrier core material and a resin coating layer on the surface of the magnetic material-dispersed resin carrier core material, the magnetic material-dispersed resin carrier core material contains a core material particle containing a magnetic material and a binder resin, and a primer compound having an amino group, the resin coating layer contains a coating resin A, which is a polymer of monomers including at least a (meth) acrylic acid ester having an alicyclic hydrocarbon group, the content of the primer compound in the magnetic material-dispersed resin carrier core material is from 0.10 parts by mass to 0.90 parts by mass with respect to 100 parts by mass of the core material particle, and the content of the resin coating layer is from 0.5 parts by mass to 5.0 parts by mass with respect to 100 parts by mass of the magnetic material-dispersed resin carrier core material.

12. The two-component developer according to claim 11, wherein the binder resin contains a crystalline polyester.

13. An image formation method, comprising:

a charging step of charging an electrostatic latent image bearing member;

an electrostatic latent image formation step of forming an electrostatic latent image on the surface of the electrostatic latent image bearing member;

a developing step of forming a toner image by developing the electrostatic latent image using a two-component developer inside a developing device;

a transfer step of transferring the toner image to a transfer material via or not via an intermediate transfer member; and a fixing step of fixing the transferred toner image to the transfer material, wherein the two-component developer includes a toner comprising a toner particle containing a binder resin, and a magnetic carrier;

the magnetic carrier has a magnetic material-dispersed resin carrier core material and a resin coating layer on the surface of the magnetic material-dispersed resin carrier core material, the magnetic material-dispersed resin carrier core material contains a core material particle containing a magnetic material and a binder resin, and a primer compound having an amino group, the resin coating layer contains a coating resin A, which is a polymer of monomers including at least a (meth) acrylic acid ester having an alicyclic hydrocarbon group, the content of the primer compound in the magnetic material-dispersed resin carrier core material is from 0.10 parts by mass to 0.90 parts by mass with respect to 100 parts by mass of the core material particle, and the content of the resin coating layer is from 0.5 parts by mass to 5.0 parts by mass with respect to 100 parts by mass of the magnetic material-dispersed resin carrier core material.

14. The two-component developer according to claim 11, which is a replenishment two-component developer for use in an image formation method that includes: a charging step of charging an electrostatic latent image bearing member; an electrostatic latent image formation step of forming an electrostatic latent image on the surface of the electrostatic latent image bearing member; a developing step of forming a toner image by developing the electrostatic latent image using a two-component developer inside a developing device; a transfer step of transferring the toner image to a transfer material via or not via an intermediate transfer member; and a fixing step of fixing the transferred toner image to the transfer material, the two-component developer being replenished to the developing device in response to a decrease in toner concentration in the two-component developer in the developing device, wherein the two-component developer contains from 2 parts by mass to 50 parts by mass of the toner particle with respect to 1 part by mass of the magnetic carrier.

15. The image formation method according to claim 13, wherein the two-component developer is replenished to the developing device in response to a decrease in toner concentration in the two-component developer in the developing device, and the replenishment two-component developer contains from 2 parts by mass to 50 parts by mass of the toner particle with respect to 1 part by mass of the magnetic carrier.

* * * * *